US005587277A

United States Patent [19]

Yamashita et al.

[11] Patent Number: 5,587,277

[45] Date of Patent: Dec. 24, 1996

[54] SOLID PROCESSING COMPOSITION FOR SILVER HALIDE LIGHT-SENSITIVE PHOTOGRAPHIC MATERIAL AND METHOD OF PROCESSING BY THE USE THEREOF

[75] Inventors: Hiroshi Yamashita; Yutaka Ueda, both of Hino, Japan

[73] Assignee: Konica Corporation, Tokyo, Japan

[21] Appl. No.: 500,644

[22] Filed: Jul. 11, 1995

Related U.S. Application Data

[63] Continuation of Ser. No. 294,580, Aug. 23, 1994.

[30] Foreign Application Priority Data

Aug. 25, 1993 [JP] Japan ..... 5-210651

[51] Int. Cl.[6] ..... G03C 5/29

[52] U.S. Cl. ..... 430/458; 430/372; 430/428; 430/460; 430/461; 430/465

[58] Field of Search ..... 430/434, 458, 430/465, 474, 475, 479, 480, 482, 372, 428, 460, 461; 427/2.14, 2.21, 221, 222

[56] References Cited

U.S. PATENT DOCUMENTS

| | | | |
|---|---|---|---|
| 3,149,040 | 9/1964 | Jeffries | 424/480 |
| 3,539,380 | 11/1970 | Johnson | 424/480 |
| 3,751,277 | 8/1973 | Small et al. | 424/479 |
| 4,423,086 | 12/1983 | Devos et al. | 424/479 |
| 4,931,286 | 6/1990 | Johnson et al. | 424/480 |
| 5,258,268 | 11/1993 | Reuter et al. | 430/458 |
| 5,366,853 | 11/1994 | Yoshimoto | 430/393 |
| 5,409,805 | 4/1995 | Haraguchi et al. | 430/449 |

*Primary Examiner*—Hoa Van Le

*Attorney, Agent, or Firm*—Frishauf, Holtz, Goodman, Langer & Chick, P.C.

[57] ABSTRACT

A solid photographic processing composition in tablet form for a silver halide photographic light sensitive material is provided, wherein at least a part of the surface of said solid processing composition is covere-coated with a compound selected from (i) a polyalkylene glycol having an average molecular weight of 2000 to 20000, (ii) a monosaccharide or disaccharide and (iii) a vinyl polymer having a betaine structure. The tablets of the processing composition are enclosed in a package, and introduced into a processing tank.

7 Claims, 7 Drawing Sheets

SOLID PROCESSING COMPOSITION FOR SILVER HALIDE LIGHT-SENSITIVE PHOTOGRAPHIC MATERIAL AND METHOD OF PROCESSING BY THE USE THEREOF

This application is a continuation, of application Ser. No. 08/294,580, filed Aug. 23, 1994.

INDUSTRIAL FIELD OF THE INVENTION

The present invention relates to a solid processing composition for silver halide light-sensitive photographic materials, a package therefor and a method of processing a silver halide light-sensitive photographic material by the use thereof. To be more Specific, the present invention relates to a tablet-form solid processing composition for silver halide light-sensitive photographic materials which is effectively prevented from frictional abrasion and deterioration in photographic processing performance, and, at the same time, which enables smooth addition upon automatic addition thereof, a package therefor and a method for the use thereof.

BACKGROUND OF THE INVENTION

A silver halide light-sensitive photographic material (hereinafter it is simply called as"the light-sensitive material") usually undergoes, after imagewise exposure to light, various photographic processes such as development, desilvering or bleach-fixing, stabilization and washing, etc.

Thus, for example, a developing solution is used for development; a bleaching solution or a bleach-fixing solution is used for desilvering process; and a fixing solution is used for fixing process; city water or deionized water is used for washing or rinsing; a stabilizing solution is used for waterless washing; and stabilization solution is used individually for dye stabilization treatment; etc.

The liquid which is used for above-mentioned photographic processing is called a processing solution, the temperatures of the respective processing solutions are usually adjusted to between 30° C. and 40° C., and the light-sensitive material is transported and dipped in these processing solutions and is processed.

The photographic processing like above is usually carried out using an automatic processing machine, which is herein after referred to as "a processor". Photographic processing is carried out by transporting a light-sensitive material into a plurality of processing baths where the above-mentioned processing solutions are contained.

Herein, the term "processor" generally means a processing apparatus which comprises a plurality of processing baths containing various processing solutions as mentioned above, and a drying compartment; and a means to automatically transport the photographic light-sensitive material. The processor has a means to automatically transport the photographic light-sensitive material through the processing baths in order.

When a light-sensitive photographic material is processed using a processor like this, in order to keep the activity of a processing solution in the processing tank constant, the replenishment of a processing agent is generally adopted.

As for the replenishing method of the processing agent, a replenishing solution in which the processing agent is dissolved is prepared beforehand.

To be specific, the processing operation is carried out while supplying a replenishing solution, which was prepared beforehand, from a tank for replenishment to the processing bath.

In this case, the replenishing solution is prepared outside the processor. Thus, in so-called a "mini photo-finishing labs.", etc., it used to be the case that the replenishing solution was prepared in a tank installed near the processor by hand operation or by the use of a mixer.

That is to say, the processing composition for the silver halide photographic light-sensitive material which is commecially available are usually in the form of powder or solution. In practice, they were dissolved in water, in the case of powder, or diluted by adding a given amount of water in the case of a solution, to prepare the replenishing solution.

The dissolving operation of the processing composition is not only complicated, but also there is a danger of contamination of the surrounding by scattering of drops of solution or adhesion thereof to human skin. Especially, this has been the case in a shop where a large amount of light-sensitive material is processed daily. Such dissolution operation has to be done many times a day, which may cause interruptions with other business of the shop.

Accordingly, in order to reduce such dissolving operation in the shop, it was proposed to supply the processing composition in the form which may be used as a replenishing solution. However, in this case, there is a drawback that since reactive compounds coexist in a solution, preservation stability thereof tends to be remarkably deteriorated. For the purpose of overcoming this drawback, a system, in which the reactive compounds are separated to two or three parts and supplied to the processing tank, has also been proposed.

In the case of the processing composition in the form of liquid, the total volume of the processing solution tends to be large because of use of water as a solvent, which is undesirable in view of space for storage and transportation.

In order to solve these problems Japanese Patent open to Public Inspection (O.P.I.) publication No. 5-119454 (1993) discloses a system, in which processing composition is solidified in the form of a tablet and, is directly supplied to the processing tank. However, when the photographic processing composition is tablet-formed by compression molding, its binding force generally becomes poor. When, on the other hand, in order to overcome this drawback, a large amount of binder etc. is employed, then, photographic processing performance can be adversely affected. Therefore, it is difficult to use a binder, etc. in a large quantity, and, in practice, it is possible to use it only in a small quantity. As a result, hardness of the tablet-form processing composition decreases and it comes to wear out easily. Moreover, since the photographic processing composition is usually used in relatively a large quantity at a time, therefore, the supply thereof tends to become too complicated if the size of the tablet is as small as ones for medical use. So, a large size tablet is more favorable in view of the mechanical strength. However, it was found that a large-sized tablet can easily wear out easily and this can be a problem. Although it might be true that this kind of problem may be prevented to some degree by wrapping the tablet individually. However, in the case of the photographic processing composition, since frequency of replenishment is relatively large, so that unpacking operations can become too complicated to open the packages, in which a plurality of individually wrapped tablets tens times a day. Moreover, the amount of the waste packing material increases. However, when two or more solid processing compositions are stored in a lump, the wear thereof becomes remarkable. Moreover, it is found to be easy to cause moisture absorption and the deterioration of the element. Furthermore, the solid processing composition becomes blocked in the feeder or the drive part of the feeder becomes clogged, causing an increase in the torque when a solid processing composition is supplied to the processing tank of the processor automatically.

Japanese Patent O.P.I. publications No. 4-172341 (1992) and No. 5-204098 (1993) disclose a solid tablet-form processing composition coated with water soluble polymer. An improvement in wearing resistance of a solid processing composition was achieved according to this method. However, it is not always sufficient under a specific condition like the above-mentioned. Moreover, from the viewpoint of practical use, there were some problems such that the water soluble polymer dissolved only in a specified processing solution, a coating material is allowed to be cracked or the tablets blocked together with each other.

SUMMARY OF THE INVENTION

The object of the present invention is to provide a tablet-form solid processing composition for silver halide light-sensitive photographic material having excellent solubility, anti-abrasion property and resistance against deterioration, and by which load of dissolution operation can be reduced, and a package thereof.

Another object of the present invention is to provide a method of processing a silver halide light-sensitive photographic material, wherein the solid processing composition can be supplied smoothly to a processor.

Still another object of the present invention is to provide a tablet-form solid processing composition for silver halide light-sensitive photographic material which is improved in moisture resistance and anti-coloring properties, and a package thereof.

The above-mentioned objects of the present invention was found to be achieved by a tablet-form solid processing composition for silver halide light-sensitive photographic material prepared by compression molding, which is characterized in that at least a part of the surface of said tablet-form solid processing composition is coated with a material selected from the group listed below in an amount of 0.05 to 5% by weight based on the total weight of the composition:

(i) Polyalkylene glycols having the average molecular weight of not less than 2,000 and not more than 20,000;

(ii) Monosaccharides and disaccharides; and (iii) vinyl polymers having a betaine structure.

EXPLANATION OF NUMERALS

Figure 1:
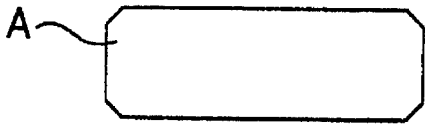
FIGS. 1(A1), 1(B1) and 1(C1) are side views showing the tablet-form solid processing composition and FIGS. 1(A2), 1(B2) and 1(C2) are top views respectively of each tablet.
Figure 1:
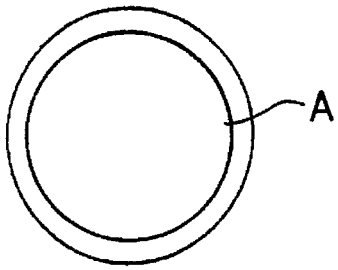
Figure 1:
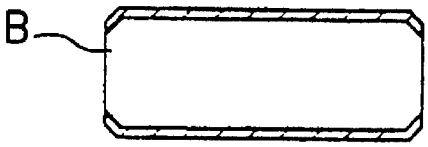
Figure 1:
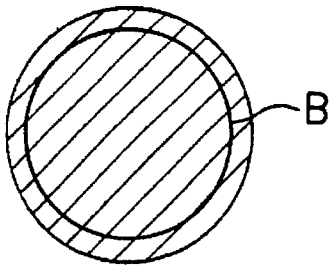
Figure 1:
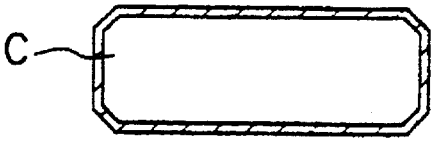
Figure 1:
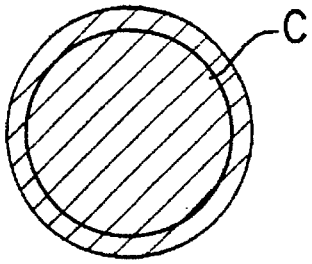

1: Color developing bath
2: Bleach-fixing bath
3: Stabilizing bath
4: Stabilizing bath
5: Stabilizing bath
6: Drying conpartment
7: Sensors for detecting processed area of light-sensitive material
8: Solid processing composition replenishing equipment
9: Sensors for detecting liquid-level
10: Water replenishing tank
11: Controller part
12: Supply means for replenishing water
13: Inlet mouth for light-sensitive material
14: Replenishing water
15: Water replenishing tube
21: Tablet-form solid processing composition
22: Canopy
23: Processing agent packaging body storage part of
24: Cylindrical container for solid processing composition
25: Sliding plate member
26: Driving device for sliding plate member
27: filtering bath
28: Filter
29: Pocket for the tablet
30: fall entrances
101: Cartridge
102: Sliding-cap
103: Stand for thecartridge
104: Rotary cylinder
105: cut mouth
106: Filtering bath
107: Filter
108: Shutter
109: Processing tank
110: Top lid
111: Tablet-form solid processing composition
122: Pocket
123: Sweeper
124: movable member
125: Motor
128: Tablet-form solid processing composition
129: Tablet line part of 129
130: Driving member for rotatable shutters
131: First shutter
132: Second shutter
133: hoppers

DETAILED DESCRIPTION OF THE INVENTION

The solid processing composition of the present invention is characterize in that it is molded in the form of a tablet by compression-molding powdery or granulated processing composition for silver halide light-sensitive photographic materials.

A preferable tablet-making process is to form a tablet after granulating powdery processing composition. As compared to a solid composition prepared simply by mixing processing composition to form a tablet, there is an advantage that improved solubility and storage stability were achieved and resultingly the photographic performance becomes stable.

As for granulation process which is carried out prior to tablet-making process, any conventionally known method such as fluidized-bed granulation process, extrusion granulation process, compression granulation process, crush granulation method, Fluid-layer granulation process, and spray-dry granulation process can be used. It is preferable that the average grain size of granules is between 100 and 1000 microns and, preferably, between 200 and 800 microns. When the average grain size thereof is smaller than 100 microns or greater than 1000 microns, it tends to cause localization of mixing elements and, therefore, is undesirable. The average grain size used in the present invention is defined in terms of arithmetic average diameter in sieving method. That is to say, assuming the median of the respective sieves as d and its frequency as n, then the average grain diameter D is given as a equation $$D=(\Sigma nd/\Sigma n),$$

using a plurality of JIS standard sieves. Not less than 60% of the granulated grains are preferably within the deviation of ±100–150 microns as for size distribution thereof.

As hydraulic press machine, any conventional compression molding machine, such as a single-engined compression molding machine, a rotary-type compression molding machine, a briquetting machine, etc. may be used to form a tablet. Thus prepared tablet-form solid processing composition can take arbitrary size and shape, however, in view of productivity, adaptability to automatic addition, and user handling operation, etc., weight of the tablet is preferably between 0.5 g and 50 g. As for the shape of the tablet, cylinder shape or convex lens shape is preferable and the diameter of the tablet may be preferably 10 to 50 mm.

It is preferable that the tablet of the present invention has a bulk density of 1.0 to 2.5 g/cm$^3$. Thus, the bulk density of not less than 1.0 g/cm$^3$ is preferable for the strength of the solid composition. A density of not more than 2.5 g/cm$^3$ is prefererable for dissolving speed thereof.

Furthermore, a tensile strength of the tablet is preferably 5 to 50 kg/cm$^2$ from the viewpoint of manufacturing operation and physical distribution thereof. If the tensile strength is not less than 5 kg/cm$^2$, there are few occurence of cracking or breaking-off of the tablet toward heat or bombardment when coated with a covering material of the present invention. Resultingty, the tablet is covered uniformly and effects of the invention has been achieved. Relation between hardness and tensile strength of the tablet is expressed by the following equation, $$\sigma=2P/\pi DT(\text{kg/cm}^2)$$

wherein $\sigma$ represents a tensile strength, P represents a hardness, D and T represent a diameter and a thickness of a tablet, respectively.

The tablet-form solid processing composition of the present invention can be used for various purposes. For example, it may be used for developer for black-and-white and color photographic materials including color negative films, color papers, color reversal films, etc., bleach, bleach-fixer agent, fixer, stabilizer, rinse, stopper, reversing agent and adjusting agents (conditioner), etc.

As for the developing agent used for black-and-white photography of the invention, for example, 1,4-dihydroxybenzene-type compounds, p-Aminophenol-type compounds and pyrazolidone-type compounds are preferable. The 1,4-dihydroxybenzene compounds include Hydroquinone, chlorohydroquinone, bromohydroquinone, iso-propyl hydroquinone, methylhydroquinone, 2,3-dichlorohydroquinone-dichlorohydroquinone, 2,3-dibromohydroquinone, 2,5-dimethylhydroquinone, hydroquinone monosulfate, etc.

As for the pyrazolidone compounds, for example, 1-phenyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, 1-phenyl-4-methyl-3-pyrazolidone, 1-phenyl-4,4-dihydroxymethyl-3-pyrazolidone, 1,5-diphenyl-3-pyrazolidone, 1-p-tollyl-3-pyrazolidone, 1-phenyl-2-acetyl-4,4-dimethyl-3-pyrazolidone, 1-(2-benzothiazolyl)-3-pyrazolidone, 3-acetoxy-1-phenyl-3-pyrazolidone, etc. may be mentioned.

As for the color developing agent used in the color developer of the present invention, p-phenylenediamine-type compounds are preferably used. For example, compounds disclosed on pages 26 through 31 of Japanese Patent O.P.I. Publication No. 4-86741 (1992), compounds disclosed on pages 29 through 31 of Japanese Patent O.P.I. Publication No. 61-289350 (1986), compounds disclosed on pages 6 through 9 of Japanese Patent O.P.I. Publication No. 3-246543 (1991), etc. may be mentioned.

As for the preservatives which are used for the color developing solution of the present invention, besides sulfites and hydroxyl amine salts, saccharide disclosed in Japanese Patent Application No. 4-218679 (1992), hydroxyl amine derivatives represented by the compounds disclosed in Japanese Patent O.P.I. Publication No. 63-106655 (1988) and hydrazine derivatives represented by the compounds disclosed in Japanese Patent O.P.I. publication No. 1-226862 (1989), etc. can be mentioned.

As for the bleaching agent used in the bleaching solution or bleach-fixing solution of the present invention, metal salts of amino polycarboxylic acid are preferable. As amino polycarboxylic acid metallic salt, ferric salts are representative, and they include, for example, ferric salt of ethylenediaminetetraacetic acid, ferric salts of diethylenetriaminepentaacetic acid, ferric salts of 1,3-propanediaminetetraacetic acid, compounds disclosed in Japanese Patent O.P.I. publications No. 2-275949 (1990), No. 4-73645 (1992), No. 4-73647 (1992), No. 4-127145 (1992), No. 4-134450 (1992), No. 4-174432 (1992), No. 4-204533 (1992), and No. 5-66527 (1993) can be mentioned.

As for the fixing agent used in the fixing solution or bleach-fixing solution of the present invention, besides thiosulfates, thio cyanide, thiourea and thio ether compounds, which are well known in the art, mesoionic compounds disclosed in Japanese Patent O.P.I. publications No. 4-130431 (1992), No. 4-143755 (1992), No. 4-143756 (1992) and No. 4-143757(1992) can also be mentioned.

As for the image stabilizing agent used in the stabilizing solution of the present invention, hexamethylene tetramine-type compounds and N-methylol compounds disclosed in Japanese Patent O.P.I. publications No. 4-194854 (1992) and No. 5-34889 (1993), aromatic or hrterocyclic aldehyde compounds and acetals or hemiacetal derivatives thereof, disclosed in Japanese Patent O.P.I. publications No. 5-66538 (1993) may be mentioned.

The polyalkyleneglycol used in the present invention, one represented by the following formula (A) is preferable:

$$HO\text{-}(A)_{n1}\text{-}(B)_{n2}\text{-}(C)_{n3}\text{-}H \qquad \text{Formula (A)}$$

wherein A, B and C independently represent a group represented by $$-CH_2CH_2O-,\ -\underset{\underset{R_{12}}{|}}{CH}-CH_2-O-,$$

$$-CH_2CH_2CH_2O-\ \text{or}\ -CH_2-\underset{\underset{R_{12}}{|}}{CH}-CH_2O-,$$

and $R_{12}$ represents a substituted or unsubstituted lower alkyl group, such as a methyl group, a ethyl group and a propyl group, or a hydroxyl group; $n_1$,$n_2$ and $n_3$ independently represent an integer of zero or 1 through 500, provided that the average molecular weight of a compound is defined as one calculated from hydroxyl value.

Specific examples of the polyalkyleneoxide used in the present invention are given below:

$$HO\left(CH_2CH_2O\right)_n H \qquad \text{A-1}$$

$$HO\left(CH_2CH_2CH_2O\right)_n H \qquad \text{A-2}$$

$$HO\left(\underset{\underset{CH_3}{|}}{CH}-CH_2O\right)_n H \qquad \text{A-3}$$

$$HO\left(CH_2-\underset{\underset{CH_3}{|}}{CH}-CH_2O\right)_n H \qquad \text{A-4}$$

$$HO\left(\underset{\underset{CH_2CH_3}{|}}{CH}-CH_2O\right)_n H \qquad \text{A-5}$$

$$HO\left(CH_2CH_2O\right)_{n1}\left(CH_2CH_2CH_2O\right)_{n2}-H \qquad \text{A-6}$$

$$HO\left(CH_2CH_2O\right)_{n1}\left(\underset{\underset{CH_3}{|}}{CH}-CH_2O\right)_{n2}-H \qquad \text{A-7}$$

$$HO\left(\underset{\underset{CH_3}{|}}{CH}-CH_2O\right)_{n1}\left(CH_2CH_2CH_2O\right)_{n2}-H \qquad \text{A-8}$$

Among these compounds, polyethyleneglycol represented by A-1 is especially preferable.

In the present invention, a term "monosaccharide" is a generic term for a polyhydroxyaldehyde, polyhydroxyketone and any reduction derivative, oxidation derivative, dioxy derivative, amino derivative or thio derivative thereof.

Many of sugar compounds are represented by a general formula $C_nH_{2n}O_n$, And, in the present invention, "monosaccharide" is defined to include compounds derived from the basic structure of sugar represented by this general formula.

Among these mono-saccharides, preferable one includes triose, tetrose,pentose, hexose, heptose and derivatives thereof.

Specific examples of the mono-saccharide used in the present invention are given as follows:

(1) Glycelaldehyde
(2) Dihydroxyacetone
(3) D-erythrose
(4) L-erythrose
(5) D-threose
(6) L-threose
(7) D-ribose
(8) L-ribose
(9) D-arabinose
(10) L-arabinose
(11) D-xylose
(12) L-xylose
(13) D-lyxose
(14) L-lyxose
(15) D-xylulose
(16) L-xylulose
(17) D-riburose
(18) L-riburose
(19) 2-dioxy-D-ribose
(20) D-allose
(21) L-allose
(22) D-altrulose
(23) L-altrulose
(24) D-glocose
(25) L-glucose
(26) D-mannose
(27) L-mannose
(28) D-gulose
(29) L-gulose
(30) D-idose
(31) L-idose
(32) D-galactose
(33) L-galactose
(34) D-talose
(35) L-talose
(36) D-quinovose
(37) L-digitalose
(38) Digitoxose
(39) Cymarose
(40) D-sorbose
(41) L-sorbose
(42) D-tagatose
(43) D-fucose
(44) L-fucose
(45) 2-dioxy-D-glucose
(46) D-psicose
(47) D-fructose
(48) L-fructose
(49) L-rhamnose
(50) D-glucosamine
(51) D-galactosamine
(52) D-mannosamine
(53) D-glycelo-D-galactoheptose
(54) D-glycelo-D-mannoheptose
(55) D-glycelo-L-mannoheptose
(56) D-glycelo-
(57) D-glycelo-D-idoheptose
(58) D-glycelo-L-glocoheptose
(59) D-glycelo-L-taloheptose
(60) D-altruheptrose
(61) D-mannoheptrose
(62) D-altruheptrose
(63) D-glucuronic acid
(64) L-glutaronic acid
(65) Threitol
(66) Erythritol
(67) Arabitol
(68) Ribitol
(69) Xylit
(70) Sorbitol
(71) Mannitol
(72) Iditol
(73) Talitol
(74) Dulcit (Galactitol)
(75) Allit (Allodulcitol)

A di-saccharides of the present invention is a generic term for a compound consisting of two mono-saccharides. Typical examples of di-saccharides are given below.

(76) Agarobiose

(77) N-acetyl
(78) N-acetyllactosamine
(79) Iso-maltose
(80) Xylobiose
(81) Gentiobiose
(82) Kojibiose
(83) Sucrose
(84) Cellobiose
(85) αα-trharose
(86) Maltose
(87) Lactose
(88) Laminaribiose
(89) Laminaribiose
(89) Lactose
(90) Laminaribiose
(91) Rutinose Among these mono-saccharides and di-saccharides, sugar alcohols (65) through (75) are especially preferable.

The "vinyl polymer having a betaine structure" used fin the present invention is defined to be a polymer comprising a polymerizable vinyl monomer unit having a intra-molecular salt consisting of a quaternary ammonium ion as a cathion and a carboxylate ion as an anion. Betaine structure in the present invention includes one which is present in the form of hydrate in solution or crystal, as a form, for example, $$R_3N^+CH_2COO^- + H_2O \rightarrow (OH)^- R_3N^+CH_2COOH$$

In the present invention, the polymer having the betaine structure may be one obtained by singly polymerizing a polymerizable vinyl monomer containing the betaine structure, but it is preferable for the polymer to be a copolymer obtained by copolymerizing the polymerizable vinyl monomer with other kind of polymerizable vinyl monomer. In the present invention, it is especially preferable that the polymer is a copolymer comprising at least one polymerizable vinyl monomer represented by general formula (I) and at least one other polymerizable vinyl monomer represented by general formula (II). In this case, other polymerable monomer than that represented by the formula (I) or (II) may also be copolymerized.

formula (I)

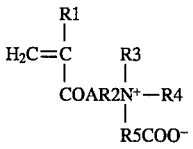

formula (II)

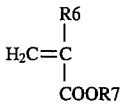

In formula (I), R1 represents a hydrogen atom or methyl group, and a methyl group is preferable. $R_2$ and $R_5$ independently represent an alkylene group having one through four carbon atoms, and among them methylene group or ethylene group is preferable. R3 and R4 independently represent an alkyl group having one through 18 carbon atoms, and methyl group or ethyl group is preferable. A represents an oxygen atom or an —NH— group, and oxygen atom is preferable.

In formula (II), $R_6$ represents a hydrogen atom or methyl group, and methyl group is preferable. R7 represents an alkyl alkenyl or alkinyl group or a cycloalkyl group.

The polymer which is advantageously used in the present invention comprises a monomer represented by formula (I) at a proportion of 20 through60% by weight, a monomer represented by formula (II) at 30 through 70% by weight and other polymerizable monomer at zero through 50 weight %, respectively.

These polymers used in the present invention may be synthesized according to the method, for example, disclosed in Japanese Patent O.P.I. Publication No. 55-17009 (1975), and they are commecially available under the tradename of "Yuka-Foamer" by Mitsubishi Oil Chemistry Co. Ltd.

Specific examples of the polymerizable monomer represented by formulae(I) and (II) are given below; However the scope of the present invention is not limited by these.

I-1

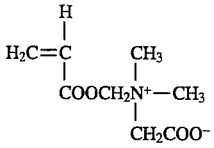

I-2

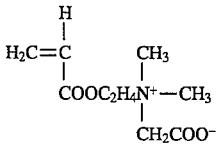

I-3

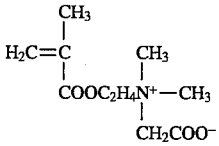

I-4

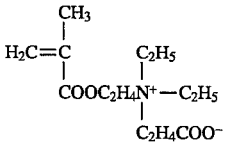

I-5

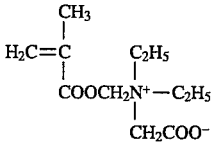

I-6

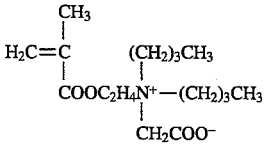

I-7

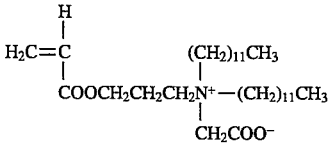

II-1

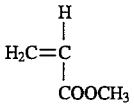

II-2

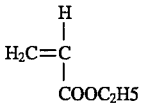

-continued

II-3

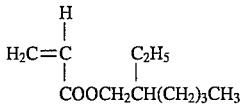

II-4

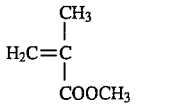

II-5

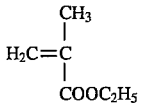

II-6

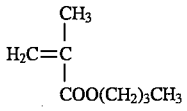

II-7

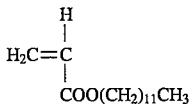

II-8

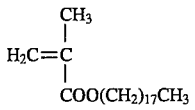

II-9

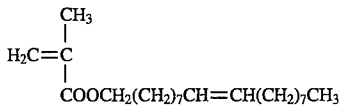

II-10

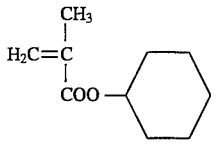

These compounds of the present invention may be incorporated inside the tablet, however, the effects of the present invention may remarkably be exerted by localizing them on the surface of the tablet. Thus, in the present invention, plural materials may be used in combination as the covering material. Further, if necessary, more than two kinds of materials may be used to provide a plurality of covering layers, by which the-effect of the present invention may be exerted more remarkably. For example, by first providing an undercoat layer with a material having good adhesion to the surface of the solid processing composition tablet, and, then coating another layer thereon, with a material of the present invention, thereby to prevent peeling off of the coating. It is also possible to provide an undercoat layer containing a preservative for the solid processing composition for the purpose of preventing deterioration, and then another covering layer may be coated thereon for the purpose of further imoproving preservation property thereof. Thus it is possible to provide multiple layers in compliance with necessity.

A covering material of the present invention is coated preferably in an amount of 0.05 to 5%, more preferably 0.2 to 2%, by weight based on the weight of the solid processing composition. When the amount is not more than 0.5% or more than 5%, effects of the invention are remarkably lowered. As for the weight ratio as defined above, in the case when the same material as a covering material is incorporated inside the tablet, the amount thereof should be included in the weight ratio.

A polyalkylene glycol having an average molecular weight of 2,000 to 20,000, a monosaccharide or disaccharide and a vinyl polymer having a betaine structure, which are applicable to the present invention are all commercially available.

In the present invention, a method for covering the surface of the solid processing composition is given below but it is not necessarily limited thereto.

(1) A covering material is melt by heating or dissolved in a solvent. Then a solid processing composition is dipped into the solution and took out therefrom, followed by drying.

(2) The covering material is dissolved in a solvent or melt by heating. And while flowing the solution, the solution is coated on the surface of the solid processing composition, followed by drying and drying it.

(3) The covering material is dissolved in a solvent or melt by heating. Then the solution is sprayed on the surface of the solid processing composition, which is then and then dried.

The coating with the spray like above (3) among these methods is especially preferable one from the point of the object of the present invention.

The spray coating is explained farther in detail. First, a coating solution is prepared by dissolving or suspending the coating material in water, an organic solvent or the mixture thereof. Water or an organic solvent such as methanol or ethanol can be used as a solvent, however, water is preferable from the point of preventing an accident such as ignitions.

Moreover, when the covering material is a compound having relatively low melting point, melting by heat may also be applied.

As for a coating method, pan coating is preferable, wherein while rotating a pan containing therein tablets of solid processing composition, a coating solution is poured or sprayed on the surface of the solid processing composition, followed by sending hot air inside the pan to remove solvent and dry the coating material.

Upon removal of the solvent or drying the coating material, pressure inside the pan may be decseased. Also, two or more kinds of coating solutions may be used successively, so that a plurality of layers are provided on the surface of the tablet.

As another method, the tablet-formed solid processing compositions are made line up on a belt and then the coating solution is sprayed thereon, followed by drying. In this case, if a net-like belt is used, the coating solution may be from both upper and lower sides of the tablet and simultaneous coating can be performed.

If the system is so designed that tablet moves on the belt from the spraying process to the drying process, a continuous manufacture of the solid processing composition is also possible.

It is preferable that the solution used for the spray coating comprises a plasticizer.

The plasticizer includes polyethylene glycol, glycerine ester, fatty acid ester of saccharose, castor oil, sorbitan, organic acid ester, barbitol derivatives, cellosolves, ethylene glycols, propyreneglycols or diethylene glycols. It is preferable for these compounds to be added to the coating solution beforehand.

Specific examples of the plasticizer used in the present invention are given below:

(1) Polyethyleneglycol
(2) Glycerintriacetate
(3) Polyoxyethylenesorbitan monolaurate, e.g., "Tween 20" a product of Kao Co., Ltd.
(4) Polyoxyethylenesorbitan monopalmitate, e.g., "Tween 40" a product of Kao Co., Ltd.

(5) Polyoxyethylenesorbitan monostearate, e.g., "Tween 60" a product of Kao Co., Ltd.
(6) Porlyoxyethylenesorbitan monoolleit, e.g., "Tween 80" a product of Kao Co., Ltd.
(7) Triethylcitrate
(8) Dibutylphthalate
(9) Di-isopropylsuccinate
(10) Carbitol
(11) Butylcarbitolacetate
(12) Dibutylcarbitol
(13) Ethylcellosolve
(14) phenylcellosolve
(15) Ethyleneglycol
(16) Propyleneglycol
(17) Diethyleneglycol Among these compounds (1), (2), (3), (7) and (16) are especially preferable.

Further, the weight average molecular weight of the polyethyleneglycol is preferably not less than 200 and not more than 10,000.

Preferable added amount of the plasticizer is between 0.01–50% more preferably 0.1–30% with respect to the weight of the coating material.

Next, the packaging embodiment of a solid processing composition of the present invention is explained.

The effect of the present invention will be exerted more remarkably when two or more kinds of processing compositions are contained in a package.

Plurality of one-kind processing compositions may be contained in a package. Plural-kind processing compositions may be contained in a package The effect of the present invention is farther remarkable when plural solid processing compositions are contained in line. The term that "contained in line" means a state such that packages of tablet form solid processing composition are lined up regularly in the same direction.

Although there is no limitation as to material used for wrapping or packaging, for example, film, plastic, paper, aluminum, and any combination thereof can be mentioned.

In processing the silver halide light-sensitive material, it is preferable for the solid processing composition of the present invention to be directly added to the processing bath in the processor, or a part of the circulatory system thereof.

Since the solid processing composition generally is inferior in solubility to one in liquid form, there has been a drawback that increased work load is imposed on the dissolution operation such as stirring. If, however, the solid processing composition, in place of a replenishing solution, can be added directly to the processing bath, dissolution of the solid processing agent can be done without any excess work load because the solution in the processing bath is maintained at a predetermined temperature and, in addition, it is regularly circulated by a pump.

At this time, in order to dilute a waste accumulated in the processing solution, it is preferable that an equivalent amount of water, which has heretofore been added in the form of replenisher, is replenished separately.

When the solid processing composition is added to the processing solution, it is preferable to use an automatic supplying apparatus, whereby the effect of the present invention can be exerted more remarkably.

EXAMPLES

The present invention is explained further in detail with reference to working examples. However, of course, the scope of the present invention is not limited by these.

Example 1

(1) Manufacture of granulated product of color developer composition for color paper Operation (i)

1200 g of color developing agent [CD-3: 4-amino-3-methyl N-ethyl-N-(β-(methanesulfonamido)ethyl)anilinesulfate] was ground into grain until the average grain size becomes 10 μm. Microns in Bandam mil, which is commercially available. After granulating it by adding 50 ml of water at room temperature, the granulated product was dried for two hours using a fluidized bed dryer at 40° C. to remove the moisture contained in the granulated product almost completely.

Operation (ii)

400 g of bis(sulfoethyl)hydroxyamine, 1000 g of sodium p-toluene sulfonate and 300 g of Cinopar SFP (a product of CibaGeigy Co. ltd) were respectively granulated in the same manner as in Operation (i). Then these grains were mixed uniformely with 300 g of Pineflow (a product of Matsugaya Chem. Co.) using a mixing machine commercially available. Next, granulation process was carried out in the same manner as Operation (i) by adding 120 ml of water. The granulated product is dried for one hour at 60° C. to remove the moisture contained in the granulated product almost completely.

Operation (iii)

500 g of sodium p-toluenesulfoniate, 20 g of sodium sulfite, 200 g of lithium hydroxide and 1700 g of potassium carbonate anhydride were respectively ground in the same manner as in Operation (i). These grains 500 g of Polyethgyleneglycol #6000 and 300 g of mannitol were mixed with in the room of which relative humidity was adjusted at below 40% RH using a mixing machine commercially available. After adding 150 ml of water and completing granulation process, which was performed in the similar manner as Operation (i), the granulated products were dried for two hours at 40° C. and the moisture in the granulated product was removed almost completely. Repeating this operation twice, granulated product was obtained.

Operation (iv)

All the granulation products manufactured in Operations (i) through(iii) were mixed altogether, and thereafter were further mixed with 100 g of sodium N-myristoyl-N-methyl-β-aranine over a period of 15 minutes using a mixing machine commercially available.

(2) Manufacture of Tablet A (FIG. 1(A1) and FIG. 1(A2)) of solid color developer composition for color paper From the mixture manufactured in the above (1), was prepared tablet-form color developer composition A for color paper with diameter of 30 mm and a weight of 10.0 g per a tablet by the use of a Tough-Press Collect 1527HU-modified tablet-manufacturing machine.

The schematic drawing of this solid processing composition is shown in FIG.1(A) and FIG. 1(A2).

(3) Manufacture of Tablet B (FIG. 1(B1) and FIG. 1(B2)) of color developer composition Compounds given in Table 1 were dissolved or suspended in water and 30 weight % aqueous solutions or suspensions of the compounds with respect the weight of the solid element were prepared. This solutions or the suspensions were sprayed on both upper and lower sides of the tablet of color developing composition (Tablet A) using an atomizer, which is available in the market. It was then dried at once with hot wind of 50°–55° C. By repeating this operation and upper and lower sides of the tablets were coated. The spraying amount per unit time and the spraying time were controlled so that the weight ratio of the covering material to the solid processing composition (covering ratio) was adjusted to be numerical values given in Table 1. Thus, tablet-form solid processing composition for color paper was referred to as Tablet B.

Schematic drawing of this solid processing composition is shown in FIGS. 1(B1) and 1(B2).

(4) Manufacture of Tablet C (FIGS. 1(C1) and 1(C2)) of color developer composition Compounds given in Table 1 were dissolved in water and 30% aqueous solutions or dispersions with respect to solid component were prepared. 5.0 kg of the above-mentioned color developer tablets A are put in AQUACOATER AQC-48T made by Freund industry. After preheating for five minutes at supply-gas temperature of about 60° C., the rotation number of a pan was set to 15 rpm. While maintaining supply-gas temperature at about 60°–65° C. and an exhaust-gas temperature at 35°–40° C., the above solution (suspension) was sprayed on the tablet with spray pressure 4 kg/cm$^2$ and in a spraying amount of 4 g/mm. The spraying time was controlled, so that the weight ratio of the covering material to the tablet of solid processing composition (covering ratio) became the value of Table 1. This was referred to as color developer Tablet C for the color paper. The schematic drawing of this solid processing composition is shown in FIGS. 1(C1) and 1(C2).

Experiment:

The abrasion, solubility, hygroscopic properties stickiness (or blocking) after storage and cracking of covering material of the tablet-form solid processing compositions for color paper (Tablets A–C) were evaluated according to the methods described below.

i) Degree of Frictional Abrasion

Six tablets were put in an abrasion testing machine, prepared by modifying one produced by Kayagaki Medical Science industries Co., Ltd.

The total weight of the tablet before and after experiment was measured and the abrasion degree was obtained from the following equation.

$$\text{Degree of Frictional Abrasion (\%)} = \frac{(\text{Total Tablet Weight before Experiment} - \text{Total Tablet Weight after Experiment})}{\text{Total Tablet Weight before Experiment}} \times 100$$

Criterion for Evaluation:

E: Excellent; less than 0.3%.

G: Good; between 0.3% and 0.4%

F: Fair; between 0.4% and 0.5%

P: Poor less than 0.5%.

ii) Solubility

One liter of color developing solution for color paper, of which composition is given below, was warmed at 38° C. and stirred with a magnetic stirrer. Then a tablet of solid color developer composition was put in a cage and was dipped in the solution so that the tablet may not come into touch with the magnetic stirrer. Time necessary for completing dissolution of the tablet was measured.

| Composition of the color developer for color paper (per 1 l.) | |
|---|---|
| Bis-(sulfoethyl)-hydroxylamine disodium salt | 4.0 g |
| Sodium p-toluene sulfonate | 15.0 g |
| CINOPARL-SFP (a product of Ciba Geigy Ltd.) | 3.0 g |
| Diethylenetriaminepentaacetic acid | 2.5 g |
| Potassium chloride | 3.5 g |
| Sodium sulfite | 0.2 g |
| Potassium Carbonate anhydride | 30 g |
| PINEFLOW | 15 g |
| Polyethyleneglycol #6000 | 5.0 g |
| Color developing agent (CD-3) | 6.5 g |

pH of the solution was adjusted to 10.0 with sulfuric acid or sodium hydroxide.

Criterion for Evaluation:

G: Good; dissolved within five minutes longer than dissolving time of Tablet A.

F: Fair; dissolved within 5–10 minutes longer than the dissolving time of Tablet A.

P: Poor; dissolved in 10 minutes or longer than the dessolving time of Tablet A.

(iii) Hygroscopic Property

A tablet was allowed to stand left for eight hours in a thermostatic chamber controlled at 25° C. and 50% RH and a moisture sorption content (hygroscopicity degree) was calculated by the following equation;

$$\text{Hygroscopicity Degree (\%)} = \frac{(\text{Weight of tablet after storage} - \text{Weight of tablet before storage})}{\text{Weight of tablet before storage}} \times 100$$

Criterion for Evaluation:

E: Excellent; Hygroscopic Degree is less than 1.0%

G: Good; Hygroscopic Degree is between 1.0 and 1.5%

F Fair; Hygroscopic Degree is between 1.5 and 2.5%

P: Poor; Hygroscopic Degree is more than 2.5%

(iv) Stickiness

After leaving two tablets for eight hours in a thermostatic chamber controlled at 25° C. and 50% RH, and the tablets were superposed with each other and left them further one hour, to evaluate degree of stikiness by the following standards:

Criterion for Evaluation:

G: Good; The tablets did not stuck at all.

F: Fair; The tablets stuck to each other but easily separate.

P: Poor; The tablets easily stuck to each other and hard to separate (v) Cracking in the Covering Material A tablet was enclosed in a polyethylene bag, which was left in a thermostatic chamber at 50° C. and 40% RH for two weeks. Then, degree of occurrence of cracks on the surface of the tablet was visually observed.

Criterion for Evaluation

G: Good; No cracks observed.

F: Fair; Small cracks observed.

P: Poor; Large cracks observed.

Results are shown in Table 1.

TABLE 1

| Experiment No. | Tablet | Coating Material | Weight Ratio of Coating Material | Frictional Abrasion | Solubility | Hygro-scopic Property | Stickiness | Cracking | Remarks |
|---|---|---|---|---|---|---|---|---|---|
| 1-1 | A | None | 0 | P | — | P | P | — | Comp. |
| 1-2 | B | PINEFLOW (*1) | 1.0 | G | G | G | P | G | Comp. |
| 1-3 | B | Eudragitto L30D-55 (*2) | 1.0 | G | G | G | G | P | Comp. |
| 1-4 | B | Polyethyleneglycol 1500 | 1.0 | F | G | P | P | G | Comp. |
| 1-5 | B | Polyethyleneglycol 2000 | 1.0 | G | G | G | G | G | Inv. |
| 1-6 | B | Polyethyleneglycol 4000 | 1.0 | G | G | G | G | G | Inv. |
| 1-7 | B | Polyethyleneglycol 6000 | 1.0 | G | G | G | G | G | Inv. |
| 1-8 | B | Polyethyleneglycol 10000 | 1.0 | G | G | G | G | G | Inv. |
| 1-9 | B | Polyethyleneglycol 20000 | 1.0 | G | G | G | G | G | Inv. |
| 1-10 | B | Polyethyleneglycol 30000 | 1.0 | G | P | G | G | F | Comp. |
| 1-11 | B | Erythritol | 1.0 | G | G | G | G | G | Inv. |
| 1-12 | B | Yuka Foamer AM-75W (*3) | 1.0 | G | G | G | G | G | Inv. |
| 1-13 | C | PINEFLOW (*1) | 1.0 | E | G | G | P | G | Comp. |
| 1-14 | C | Eudragitto L30D-55 (*2) | 1.0 | E | G | E | G | P | Comp. |
| 1-15 | C | Polyethyleneglycol 1500 | 1.0 | F | G | P | P | G | Comp. |
| 1-16 | C | Polyethyleneglycol 2000 | 1.0 | E | G | E | G | G | Inv. |
| 1-17 | C | Polyethyleneglycol 4000 | 1.0 | E | G | E | G | G | Inv. |
| 1-18 | C | Polyethyleneglycol 6000 | 1.0 | E | G | E | G | G | Inv. |
| 1-19 | C | Polyethyleneglycol 10000 | 1.0 | E | G | E | G | G | Inv. |
| 1-20 | C | Polyethyleneglycol 20000 | 1.0 | E | G | E | G | G | Inv. |
| 1-21 | C | Polyethyleneglycol 30000 | 1.0 | E | P | E | G | F | Comp. |
| 1-22 | C | Erythritol | 1.0 | E | G | E | G | G | Inv. |
| 1-23 | C | Mannitol | 1.0 | E | G | E | G | G | |
| 1-24 | C | D-glucose | 1.0 | G | G | G | G | G | |
| 1-25 | C | Malutose | 1.0 | G | G | G | G | G | |
| 1-26 | C | Lactose | 1.0 | G | G | G | G | G | |
| 1-27 | C | Yuka Foamer AM-75W (*3) | 1.0 | E | G | G | G | G | Inv. |
| 1-28 | C | Yuka Foamer AM-75W (*4) (Polyethyleneglycol 600) | 1.0 | E | G | E | G | G | Inv. |
| 1-29 | C | Yuka Foamer AM-510 (*5) (Polyethyleneglycol 600) | 1.0 | E | G | E | G | G | Inv. |
| 1-30 | C | Polyethyleneglycol 6000 | 0.02 | P | G | P | F | G | Comp. |
| 1-31 | C | Polyethyleneglycol 6000 | 0.04 | P | G | P | F | G | Comp. |
| 1-32 | C | Polyethyleneglycol 6000 | 0.05 | G | G | G | G | G | Inv. |
| 1-33 | C | Polyethyleneglycol 6000 | 0.1 | G | G | G | G | G | Inv. |
| 1-34 | C | Polyethyleneglycol 6000 | 0.2 | E | G | E | G | G | Inv. |
| 1-35 | C | Polyethyleneglycol 6000 | 0.5 | E | G | E | G | G | Inv. |
| 1-36 | C | Polyethyleneglycol 6000 | 1.0 | E | G | E | G | G | Inv. |
| 1-37 | C | Polyethyleneglycol 6000 | 2.0 | E | G | E | G | G | Inv. |
| 1-38 | C | Polyethyleneglycol 6000 | 3.0 | G | G | E | G | G | Inv. |
| 1-39 | C | Polyethyleneglycol 6000 | 5.0 | G | G | E | G | G | Inv. |
| 1-40 | C | Polyethyleneglycol 6000 | 7.0 | F | P | G | G | F | Comp. |
| 1-41 | C | Erythritol | 0.02 | P | G | P | F | G | Comp. |
| 1-42 | C | Erythritol | 0.04 | P | G | P | F | G | Comp. |
| 1-43 | C | Erythritol | 0.05 | G | G | G | G | G | Inv. |
| 1-44 | C | Erythritol | 0.1 | G | G | G | G | G | Inv. |
| 1-45 | C | Erythritol | 0.2 | E | G | E | G | G | Inv. |
| 1-46 | C | Erythritol | 0.5 | E | G | E | G | G | Inv. |
| 1-47 | C | Erythritol | 1.0 | E | G | E | G | G | Inv. |
| 1-48 | C | Erythritol | 2.0 | E | G | E | G | G | Inv. |
| 1-49 | C | Erythritol | 3.0 | G | G | E | G | G | Inv. |
| 1-50 | C | Erythritol | 5.0 | G | G | E | G | G | Inv. |
| 1-51 | C | Erythritol | 7.0 | F | P | G | G | F | Comp. |
| 1-52 | C | Yuka Foamer AM-75W (*4) (Polyethyleneglycol 600) | 0.02 | P | G | P | F | G | Comp. |
| 1-53 | C | Yuka Foamer AM-75W (*4) (Polyethyleneglycol 600) | 0.04 | P | G | P | F | G | Comp. |
| 1-54 | C | Yuka Foamer AM-75W (*4) (Polyethyleneglycol 600) | 0.05 | G | G | G | G | G | Inv. |
| 1-55 | C | Yuka Foamer AM-75W (*4) (Polyethyleneglycol 600) | 0.1 | G | G | G | G | G | Inv. |
| 1-56 | C | Yuka Foamer AM-75W (*4) (Polyethyleneglycol 600) | 0.2 | E | G | E | G | G | Inv. |
| 1-57 | C | Yuka Foamer AM-75W (*4) (Polyethyleneglycol 600) | 0.5 | E | G | E | G | G | Inv. |
| 1-58 | C | Yuka Foamer AM-75W (*4) (Polyethyleneglycol 600) | 1.0 | E | G | E | G | G | Inv. |
| 1-59 | C | Yuka Foamer AM-75W (*4) (Polyethyleneglycol 600) | 2.0 | E | G | E | G | G | Inv. |
| 1-60 | C | Yuka Foamer AM-75W (*4) (Polyethyleneglycol 600) | 3.0 | G | G | E | G | G | Inv. |
| 1-61 | C | Yuka Foamer AM-75W (*4) (Polyethyleneglycol 600) | 5.0 | G | G | E | G | G | Inv. |
| 1-62 | C | Yuka Foamer AM-75W (*4) (Polyethyleneglycol 600) | 7.0 | G | P | G | G | F | Comp. |

TABLE 1-continued

| Experiment No. | Tablet | Coating Material | Weight Ratio of Coating Material | Frictional Abrasion | Solubility | Hygro-scopic Property | Stickiness | Cracking | Remarks |
|---|---|---|---|---|---|---|---|---|---|

(*1) Decomposotion product of starch, a product Matsutani Chemical Industries Co., Ltd.
(*2) A methacrylic acid copolymer, a product of Rehm Pharma Co.
(*3) Betaine-type vinyl copolymer, a product of Mitsubishi Yuka Co., Ltd.
(*4) One percent of polyethyleneglycol 600 was added to the coating solution as a plasticizer together with the above-mentioned copolymer.
(*5) Two percent of polyethyleneglycol 600 was added to the coating solution as a plasticizer together with the betaine-type vinyl copolymer produced by Mitsubishi Yuka Co., Ltd. (solid component of the solution was 18%).

From Table 1, it is understood that better results are obtained with respect to frictional abrasion, solubility, hygroscopic property, stickiness and ocurrence of cracks on the surface of the tablet when the covering material according to the present invention is used.

The effects of the present invention can be observed when only a part of the surface of the solid processing composition tablet is covering with the covering material of the present invention, (See Experiment Nos. 1–5 through 1–9, 1–11 and 1–12) but the effects of the invention become remarkable when substantially the whole surface of the solid processing composition tablet is coated with the covering material of the present invention (1–16 through 1–20,and 1–22 through 1–29). In the case where the covering material of the present invention is either a mono-succharide or a di-succharide, effects of the invention become remarkable in the case of sugar alcohol (1–22 and 1–23).

Moreover, when a vinyl polymer having a betaine structure is used, the effects become remarkable when a plasticizer is added to the coating solution (1–28 and 1–29).

It was also found that all the effects of the present invention become satisfactory when a weight ratio of the covering material to the solid processing composition is not less than 0.05% and not more than 5% particularly, between 0.2 and 2%.

Example 2

Granulation and tablet forming processes were carried out in the same manner as in Operation (iii) in Example 1, except that amounts of polyethyleneglycol and mannitol per the total weight of the solid processing composition was varied as shown in Table 2. While adjusting the weight ratio of the covering material the to solid processing composition (covering ratio) in a manner similar to (4) of Example 1, tablet-form color developing compositions for color printing paper were spray-coated.

Then, frictional abrasion and gygroscopic property of the tablets were evaluated in the same manner as Example 1.

Results are shown in Table 2.

TABLE 2

| Experiment No. | Ratio of PEG-6000 | Ratio of Mannitol | Coating Material (Weight Ratio) | Frictional abrasion | Hygroscopic Property | Remarks |
|---|---|---|---|---|---|---|
| 2-1 | 0% | 0% | 0% | P | P | Comp. |
| 2-2 | 1% | 0% | 0% | P | P | Comp. |
| 2-3 | 5% | 0% | 0% | P | P | Comp. |
| 2-4 | 10% | 0% | 0% | P | P | Comp. |
| 2-5 | 20% | 0% | 0% | F | P | Comp. |
| 2-6 | 30% | 0% | 0% | G | F | Comp. |
| 2-7 | 0% | 1% | 0% | P | P | Comp. |
| 2-8 | 0% | 5% | 0% | P | P | Comp. |
| 2-9 | 0% | 10% | 0% | P | P | Comp. |
| 2-10 | 0% | 20% | 0% | F | P | Comp. |
| 2-11 | 0% | 30% | 0% | F | P | Comp. |
| 2-12 | 0% | 0% | Polyethyleneglycol 6000 (0.1%) | G | G | Inv. |
| 2-13 | 0% | 0% | (0.5%) | E | E | Inv. |
| 2-14 | 0% | 0% | (1%) | E | E | Inv. |
| 2-15 | 0% | 0% | Mannit (0.1%) | G | G | Inv. |
| 2-16 | 0% | 0% | (0.5%) | E | E | Inv. |
| 2-17 | 0% | 0% | (1%) | E | E | Inv. |

It was seen from Table 2 that in the case where polyethyleneglycol or mannitol were incorporated inside the tablets, improvements in frictional abrasion and hygroscopic property are relatively small, whereas in th case where these materials are coand on the surface of the tablet, the effects of the present invention are remarkable even in a relatively small amount thereof.

Example 3

A processing composition tablet for the color negative film was manufactured according to the operations described below.

1) Manufacture of tablet-form color developer composition for color negative film:

Operation (i)

375 g of potassium carbonate, 58.0 g of sodium sulfate, 24.0 g of penta-sodium diethylenetriaminepentaacetate, 50.0 g of polyethylene glycol (PEG#6000) and 80.0 g of mannit were respectively ground in, by using Bandam mil to farm fine powder grains having an average size of 10 microns.

The powder was then granulated in a conventional mixing granulator at room temperature for 7 minutes, by adding 100 ml of water. The granulated product was then dried for 60 minutes at 70° C., using a fluidized bed dryer, which is available on the market,, to remove the moisture in the product almost completely.

Operation (ii)

36.0 g of hydroxylamine sulfate, 4.3 g of potassium bromide, 2.0 g of di-sodium disulfocatecohl and 2.0 g of PINEFLOW (product of Matsutani Chemical Industries Co., Ltd.) were, after being ground into powder, mixed and granulated in the same manner as in operation (i). Water was added in an amount of 3.5 ml, and after granulation, the product was dried for 60 minutes at 60° C., to remove moisture in the granulated product almost completely.

Operation (iii)

150 g of developing agent CD-4, 4-amino-3-methyl-N-ethyl-β-hydroxyethylaniline sulfate was ground into powder, and then granulated, for 7 minutes, by adding 10 ml of water in the same manner as in Operation (i). Thereafter, the granules were dried at 40° C. over a period of two hours to remove moisture contained in the granules.

Operation (iv)

Granulates prepared in operations (i), (ii) and (iii) were mixed by a commercially-available cross-rotary type mixer over a period of 10 minutes and 0.3 g of sodium N-myrystoylalanin was added thereto and mixing was conducted further for 3 minutes. From thus-obtained mixture, there was prepared 600 tablets of color developer composition for color negative film having a diameter of 30 mm, a thickness of 10 mm and a weight of 10.3 g per a tablet by using a rotary tabletting machine (Clean Press Collect, produced by Kikusui Seisakusho).

2) Manufacture of bleach composition tablet for a color negative film

Operation (v)

1900 g of ferric ammonium 1,3-propanediaminetetraacetate monohydrate, 95.0 g of 1,3-propanediaminetetraacetic acid, 860.0 g of potassium bromide, 984.0 g of succinic acid, 401.0 g of disodium succinate hexahydrate, 30.0 g of Demol MS (produced by Kao), 15.0 g of mannit and 50 g of β-cyclodextrin were ground into powder and granulated by adding 80 ml of water. Resulting granules were subjected to drying for 120 minutes at 60° C. to remove moisture contained therein.

Operation (vi)

6 g of sodium N-lauroylsarcosine was added to the granules prepared in the above (v) and the mixture was further subjected to mixing for 3 minutes. From the mixture, were prepared bleach composition tablets having a diameter of 30 mm, a thickness of 10.0 mm and a weight of 11.1 g per tablet were prepared in a manner similar to the above (iV).

3) Manufacture of fixer composition tablet for a color negative film

Operation (vii)

2500 g of ammonium thiosulfate, 180 g of sodium sulfite, 20 g of patassium carbonate, 20 g of disodium ethylenediaminetetraacetate and 65 g of PINEFLOW (a product by Matsutani Chemistries Co., Ltd.) were ground, mixed and granulated in the same manner as in Operation (i). Water was added in an amount of 50 ml and the resulting granulated product was then dried for 120 minutes at 60° C. to remove the moisture in the granular product almost completely.

Operation (viii)

The granular product manufactured according to Operation (vii) and 13 g of Sodium N-lauroylsarcosine were mixed for three minutes in a mixer in the room of which temperature and relative humidity were adjusted at 25° C. and not more than 40%, respectively. Then the mixture was put in a tablet manufacturing machine, one obtained by modifying Tough-Press Collect 1527HU, a product of Kikusui Manufacturing Co., Ltd, and there were produced 280 fixing composition tablets for colr negatives, of which weight of the single tablet was 9.3 g.

4) Manufacture of stabilizing composition tablet for color negative film

Operation (ix)

1500 g of m-hydroxybenzaldehyde, 50.0 g of Megafack F116 (a product of Dainippon Ink Co., Ltd.), 200 g of disodium ethylenediaminetetraacetate, 160 g of Litium hydroxide monohydrate and 100 g of PINEFLOW were crushed, mixed and granulated in the same manner as in Operation (i).

Water was added in an amount of 100 ml and the resulting granulated product was then dried for 120 minutes at 50° C. to remove the moisture contained in the granular product almost completely.

Operation (x)

The granular product obtained in Operation (ix) was tabletted to form stabilizing composition tablets for color negatives in the room of which temperature and relative humidity were adjusted at 25° C., not more than 40%, respectively, in the same manner as in Operation (i). Diameter, thickness and weight of the tablet were 30 mm, 10.0 mm and 8.9 g, respectively.

5) Color developing composition tablet for color paper

Tablet A used in Example 1 was used.

6) Manufacture of bleach-fixing replenisher composition tablet for color paper

Operation (xi)

1450 g of ferric ammonium diethylenetriaminepentaacetate monohydrate and 80 g of diethylenetriaminepentaacetic acid were ground into powder by using Bandam mil to farm power grains having an average diameter of 10 microns.

To this powder mixture, 450 g of polyethyleneglycol #6000 was added and the mixture was granulated in a conventional agitation granulator by adding 100 ml of water.

The granulated product was then dried using a flowing bed dryer at 40° C. for two hours.

Operation (xii)

1850 g of ammonium thiosulfate and 250 g of sodium sulfite were cruched in the same manner as in Operation (xi) and, then, 100 g of PINEFLOW (a product of Matsutani Chemical Industries Co., Ltd.) was added to the mixture, which was granulated in the same manner as in Operation (xi). Water was added in a amount of 120 ml and the resulting granulated product was then dried for 120 minutes at 60° C. to remove the moisture contained in the granular product almost completely.

Operation (xiii)

The granular product obtained in Operations (xi) and (xii), and 40 g of sodium lauroylsarcosinate were mixed for five minutes using a mixer in the room of which temperature and relative moisture were adjusted at 25° C. and not more than 40%, respectively.

The mixture was put in a tablet manufacturing machine, one obtained by modifying Tough-Press Collect 1527HU, a product of Kikusui Manufacturing Co., Ltd, and fixing composition tablets for colr negatives , of which diameter, thickness and weight were 30 mm, and 8.9 g, respectively, was manufactured.

7) Stabilizing composition tablet for color paper Operation (xiv)

10 g of sodium carbonate monohydrate, 200 g of disodium 1-hydroxyethane-1,1-diphosphonate, 150 g of Cinopar SFP (CibGeigy Ltd.), 300 g of sodium sulfite, 200 g of zinc sulfate hepta hydrate, 150 g of disodium ethylenediaminetetraacetate, 200 g of ammonium sulfate, 10 g of o-phenylphenol and 25 g of PINEFLOW were ground, mixed and granulated in the same manner as in Operation (iii). Water was added in an amount of 60 ml and the resulting granulated product was then dried for 60 minutes at 70° C. to remove the moisture contained in the granular product almost completely.

The granular product and 10 g of sodium N-lauroylsarcosine were mixed for three minutes in a mixer in the room of which temperature and relative humidity were adjustedb at 25° C. and not more than 40%, respectively. The mixed product was put in a tablet manufacturing machine and a stabilizing composition tablet for colr paper of which diameter and weight are 30 mm, and 11 g, respectively, was manufactured.

8) Cover-coating of the tablet

Tablets obtained in above-mentioned 1) through 7) were coated as follows:

b 6.0kg of the tablets were put in Dorea Coater Type-500 (a product of PAUREC Ldt.). After adjusting the temperaturesn of in-let and out-let air at 40° to 45° C., rotation of the pan was set at 8 r.p.m. Then a coating solution, consisting of YUKA FOAMER AM-75W, YUKA FOAMER AM-75 510, polyethyleneglycol 600 and water in the proportion of 18:30:1:1 was sprayed on the surface of the tablet at spraying pressure of 2.0 kg/cm$^2$, and spraying rate of 5 g min, so that weight of the coating material against the total weight of the tablet became 1.0% by weight.

Experiment

Cover-coated 40 tablets each of 1) through 7) as above-mentioned were sealed-off into a bag of polyethylene.

After leavig the bag for one month in a thermostatic chamber,in which temperature and relative humidity are adjusted at 40° C. and 70%, respectively, the following evaluiations were carried out.

i) Hygroscopic property:

A hygrscopicity degree, which was averaged out for 40 tablets was determined based on the following equation.

$$\text{Hygrscopicity degree (\%)} = \frac{\text{(Total weight of tablets after storage} - \text{Total weight of tablets before storage)}}{\text{Total weight of tablets before storage}} \times 100$$

Based on the above, hygroscopicity was evaluated according to the following criterion:

E: Excellent; hygroscopicity degree, less than 0.2%

G: Good; hygroscopicity degree, 0.2 to 0.5%

F: Fair; hygroscopicity degree, 0.5 to 1.0%

P: Poor, hygroscopicity degree, more than 1.0% ii) Coloring:

Tablets after storage were visually evaluated according to the following criterion.

A: No coloring was observed.

Slightly-coloring was observed (no problem in practical use).

C: Coloring clearly was observed.

D: Remarkably-coloring was observed.

iii) Hardness

Using a hardness tester (a product of Okada Seikosha), hardness was evaluated for 10 tablets portion taken from 40 tablets with respect to changes between before and after storage.

Criterion for evaluation:

A: Decrease of less than 10% after storage

B: Decrease of 10 to 20% after storage

C: Decrease of 20 to 50% after storage

D: decrease of more than 50% after storage

Results thereof are shown in Table 3.

TABLE 3

| Experiment No. | Processing composition tablet | Cover-coating | Evaluation: Hygroscopic property | Coloring | Hardness | Remarks |
|---|---|---|---|---|---|---|
| 3-1 | Color Developer for Color Negative | Yes | G | B | B | Inv. |
| 3-2 | " | No | P | D | D | Comp. |
| 3-3 | Bleach for Color Negative | Yes | G | B | B | Inv. |
| 3-4 | " | No | F | C | D | Comp. |
| 3-5 | Fixer for Color Negative | Yes | G | A | B | Inv. |
| 3-6 | " | No | P | C | D | Comp. |
| 3-7 | Stabilizer for Color Negative | Yes | E | B | A | Inv. |
| 3-8 | " | No | F | C | B | Comp. |
| 3-9 | Color Developer for Color Paper | Yes | G | B | B | Inv. |
| 3-10 | " | No | P | D | D | Comp. |
| 3-11 | Bleach-Fixer for Color Paper | Yes | G | B | B | Inv. |
| 3-12 | " | No | P | C | D | Comp. |
| 3-13 | Stabilizer for Color Paper | Yes | E | A | A | Inv. |
| 3-14 | " | No | G | B | C | Comp. |

As can be seen from the table, cover-coated tablets of the invention were shown to be excellent in storage stability.

Example 4

Tablets of color developer composition for color paper were prepared in a manner similar to (1) and (2) in Example 1, provided that a weight of the tablet was adjusted to be as shown in Table 4. The tablets were further cover-coated with YUKA FOAMER in the same manner as in 8) of Example 3. Thus prepared tablets were loaded into a package in the form as shown in FIGS. 2(A) through 2(E).

Figure 2A:
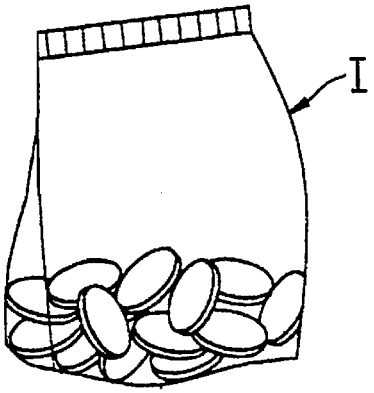
FIGS. 2(A) to 2(E) illustrate embodiments of a packaging container of the solid processing composition.
Figure 2B:
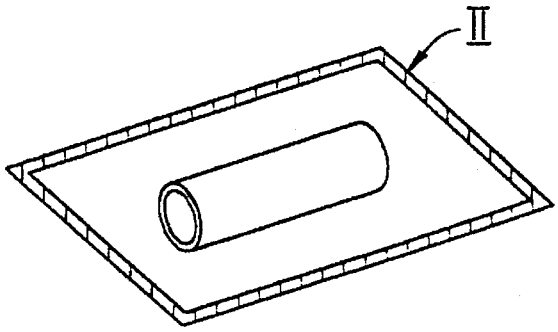
Figure 2C:
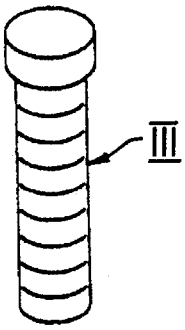
Figure 2D:
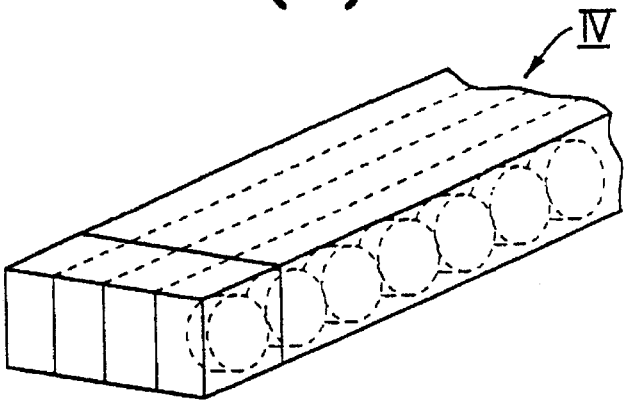
Figure 2E:
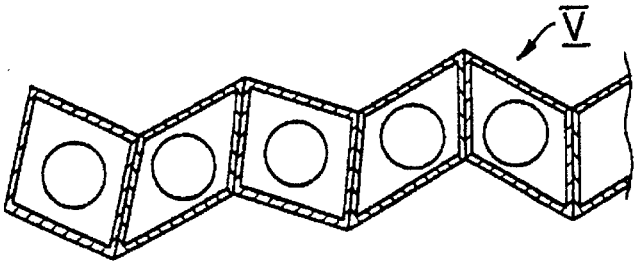

FIG. 2(A) illustrates packaging-form (I) wherein 40 tablets were enclosed in a bag made of polyethylene. Packaging-form (II), as shown in FIG. 2(B), is that 10 tablets are arranged in order and enclosed in a paper-made cyrindrical tube, which was further sealed with aluminium-laminated polyethylene film. Package (III) as illustrated in FIG. 2(C) is that 20 tablets were arranged in a polyethylen container, which was sealed with a polyethylene cap. Package (IV) as illustrated in FIG. 2(D) is that tablets were loaded in a polyethylene container, in which 10 tablets portions were each arranged in four divisinal rooms, and which was sealed with a polyethylene cap. Package (V) as illustrated in FIG. 2(E) is that tablets were each sealed with aluminium-laminated polyethylene film, and a 10 tablets portion was enclosed in a package.

Experiment

Solid developer compositions which were enclosed in a package in the form as illustrated in FIGS. 2(A) through 2(E) were kept for one month in a thermostating chamber of 50° C. and 50% R.H. Thereafter, the solid compositions were examined with respect to hygroscopicity (weight ratio) and hardness. Separately, after vibrating each of the packaged solid composions, production of fine powder was visually examined. Evaluation thereof was made based on the following criterion.

A: No fine powder was produced.

B: Fine powder was produced in a slight amount.

C: Powder was fairly produced, and abrasion of the tablet surface was observed.

D: Powder-production was remarkable, and missing of a portion of the tablet was observed.

Results thereof are shown in Table 4, in which hygroscopicity and hardness were evaluated in the same manner as in Example 2.

TABLE 4

| | | | Without Cover-coating (Comparison) | | | With Cover-coating (Invention) | | |
|---|---|---|---|---|---|---|---|---|
| Experiment No. | Package-Form | Weight of a tablet (g) | Hygroscopic Property | Hardness | Powder | Hygroscopic Property | Hardness | Powder |
| 4-1 | I | 0.2 | P | C | C | F | C | B |
| 4-2 | I | 0.3 | P | C | C | F | C | B |
| 4-3 | I | 0.5 | F | D | D | G | B | B |
| 4-4 | I | 1.0 | F | D | D | G | B | B |
| 4-5 | I | 2.0 | F | D | D | G | B | A |
| 4-6 | I | 5.0 | F | D | D | G | B | A |
| 4-7 | I | 10 | F | D | D | G | B | A |
| 4-8 | I | 20 | F | D | D | G | B | A |
| 4-9 | I | 50 | F | D | D | G | B | B |
| 4-10 | I | 70 | F | D | D | G | C | C |
| 4-11 | I | 100 | F | D | D | G | C | C |
| 4-12 | II | 10 | F | D | C | E | A | A |
| 4-13 | III | 10 | F | D | C | E | A | A |
| 4-14 | IV | 10 | F | D | C | E | A | A |
| 4-15 | V | 10 | G | C | B | E | A | A |

As can be seen from Table 4, effects of the invention were remarkable in the cases where the weight of the tablet was within a range of 0.5 to 50, preferably 2.0 to 20 g per tablet. It is also shown that the effects of the invention were remarkable in the cases where a plurality of developer composition tablets were enclosed together in a package (4-1 through 4-13). It is further noted that the packaging form in which the tablets were orderly-arrangingly enclosed (4-12 to 4-14) led to superior results as compared to the packaging form in which the tablets were randomly enclosed (4-7).

Example 5

Granules of developer composition prepared in (1) of Example 1 were fractionated with respect to grain sizes. Using granules having an average grain size as shown in Table 5, tablets of thedeveloper composition for color paper were prepared in the same manner as in Example 1. Thus prepared tablets were cover-coated with YUKA FOAMER in the same manner as in Example 3.

Tablets with or without cover-coating were sealed with aluminium-laminated polyethylene film as illustrated in FIG. 2(B), and then kept for one month in a thermostating chamber of 55° C. and 60% R.H.

Tablets aged were evaluated with respect to hardness and frictional abrasion thereof as in Examples 1 and 3. Results thereof are shown in Table 5.

TABLE 5

| With Cover-coating | | | | Without Cover-coating | | | |
|---|---|---|---|---|---|---|---|
| Experiment No. | Average Grain Size (μm) | Hardness | Frictional Abrasion | Experiment No. | Average Grain Size (μm) | Hardness | Frictional Abrasion |
| 5-1 | 50 | B | G | 5-10 | 50 | D | P |
| 5-2 | 80 | B | G | 5-11 | 80 | D | P |

TABLE 5-continued

| With Cover-coating | | | | Without Cover-coating | | | |
|---|---|---|---|---|---|---|---|
| Experiment No. | Average Grain Size (μm) | Hard-ness | Frictional Abrasion | Experiment No. | Average Grain Size (μm) | Hard-ness | Frictional Abrasion |
| 5-3 | 100 | A | E | 5-12 | 100 | D | P |
| 5-4 | 200 | A | E | 5-13 | 200 | D | P |
| 5-5 | 500 | A | E | 5-14 | 500 | D | P |
| 5-6 | 800 | A | E | 5-15 | 800 | D | P |
| 5-7 | 1000 | A | E | 5-16 | 1000 | D | P |
| 5-8 | 1200 | B | G | 5-17 | 1200 | D | P |
| 5-9 | 1500 | B | G | 5-18 | 1500 | D | P |

As can be seen from Table 5, cover-coated tablets of the invention, which was prepared from granules having average grain size of 100 to 1000 μm achieved excellent results in hardness and frictional abrasion.

Example 6

(1) Preparation of tablets of color developer composition for color paper:

Tablets of develop agent for color paper was prepared in the same manner as (1) and (2) in Example 1. Then the surface of the tablets thus prepared were coated with the covering materials given in Table 6 in the same manner as Operation (4) in Example 1. The ratio of the covering material to the tablet was adjusted to be 1.0% by weight.

(2) Preparation of tablet-form bleach-fixing agent for color paper

Tablet-form bleach-fixing agent for color paper was prepared in the same manner as in 6) of Example 3. The surface of the tablets was coated with the covering material given in Table 6 in the same manner as in Operation (4) of Example 1. The ratio of the covering material to the tablet was adjusted to be 0.5% by weight.

(3) Automatic supplying apparatus of solid processing composition

Figure 3:
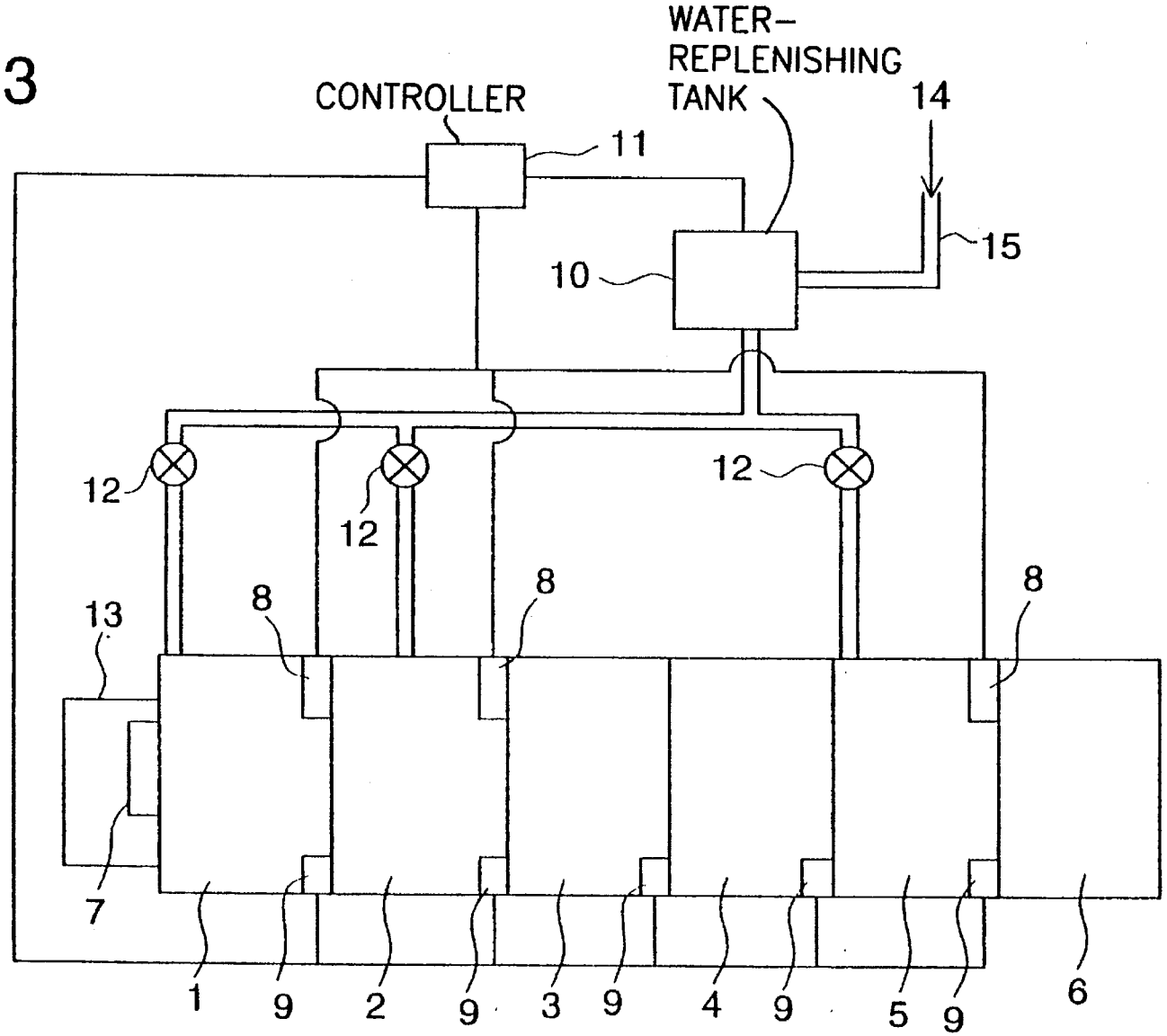
FIG. 3 is a schematic plan view of a processor for color paper (plan view).

FIG. 3 is a schematic plan view of a processor used in the present invention,briefly showing a controlling system employed in a processor for color paper.

In the drawing, processing baths 1 through 5 are arranged consecutively and processing bath 1 is one for color development; processing bath 2 is one for breach-fixing and baths 3 through 5 are ones for stabilization. At the rear of bath 5 is a dryer compartment 6. At the entrance of color development processing bath 1, there is provided an inlet mouth for light-sensitive materials 13., which is equipped, on the side of the color development processing bath 1, with a sensor 7 for detecting processed area of the light-sensitive material.

As regards stabilization baths 3 through 5, baths 3 and 4 and baths 4 and 5 are respectively connected with each other under the surface of the processing solution so that the level of the suface of the processing solution may be constant.

An Automatic supplying apparatus of solid processing composition 8 is provided with color development processing bath 1, bleach-fixing bath 2 for breach-fixing and stabilization bath 5, respectively, to supply tablet- form solid processing composition corresponding to the process.

A sensor 9 for detecting the level of the surface of the processing solution is provided with the respective baths 1 through 5.

Color development processing bath 1, breach-fixing bath 2 and stabilization bath 5 are respectively connected with a water-replenishing tank 10 through a replenishing water supplying means 12. The water-replenishing tank 10 is connected with water-supplying tube 15 and replenishing water is supplied through this. Controller 11 receives a signal from the sensor 7 and the sensor 9 and controlls supplying apparatus of solid processing composition 8, water-replenishing tank 10 and replenishing water supplying means 12.

When color paper is introduced through inlet mouth for light-sensitive materials 13, passes through the sensor 7 for detecting processed area of the light-sensitive material and a predetermined value is detected, the automatic supplying apparatus of solid processing composition 8, water-replenishing tank 10 and replenishing water supplying means 12 operate by receiving a signal from Controller 11 and necessary amount of solid processing composition and replenishing water are supplied to the baths 1, 2 and 5.

When the processor operates for several hours, adjusting the temperature of the processing solutions at predetermined level, evaporation of the processing solutions in the processing baths 1 through 5 takes place and the level of the surface of the processing solution falls down the predetermined level, then the sensor 9 for detecting the level of the surface of the processing solution works to operate the water-replenishing tank 10 and replenishing water supplying means 12, and the replenishing water is supplied until a sensor for detecting the upper limit of the solution becomes operative. In this case it is preferable that temperature of the replenishing water supplied through the water-supplying tube 15 is adjusted in advance as well as the the replenishing water for the processing solution and the water for compensating the loss by evaporation.

Figure 4:
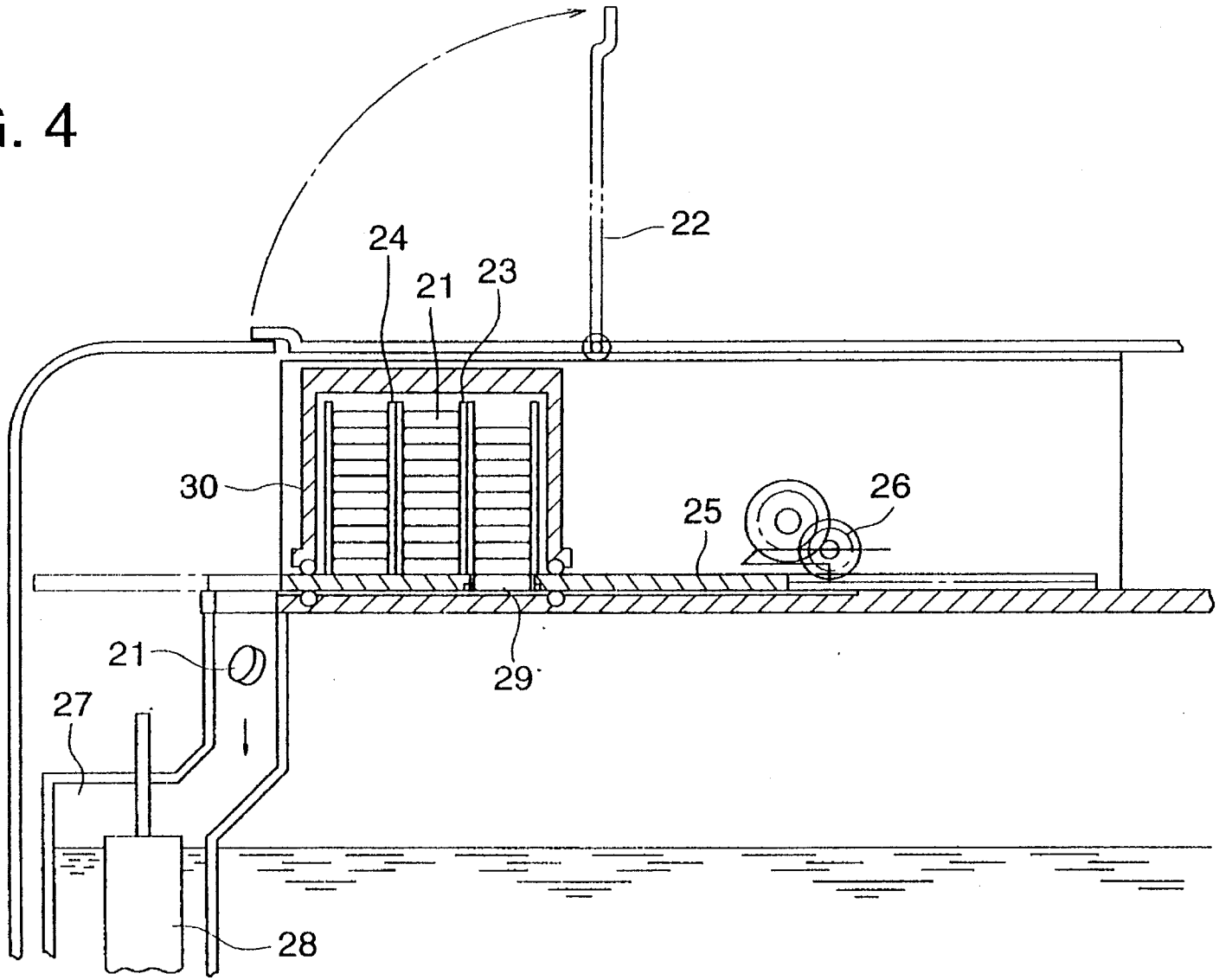
FIG. 4 illustrates an automatic feeder of the tablet-form solid processing composition.
Figure 5:
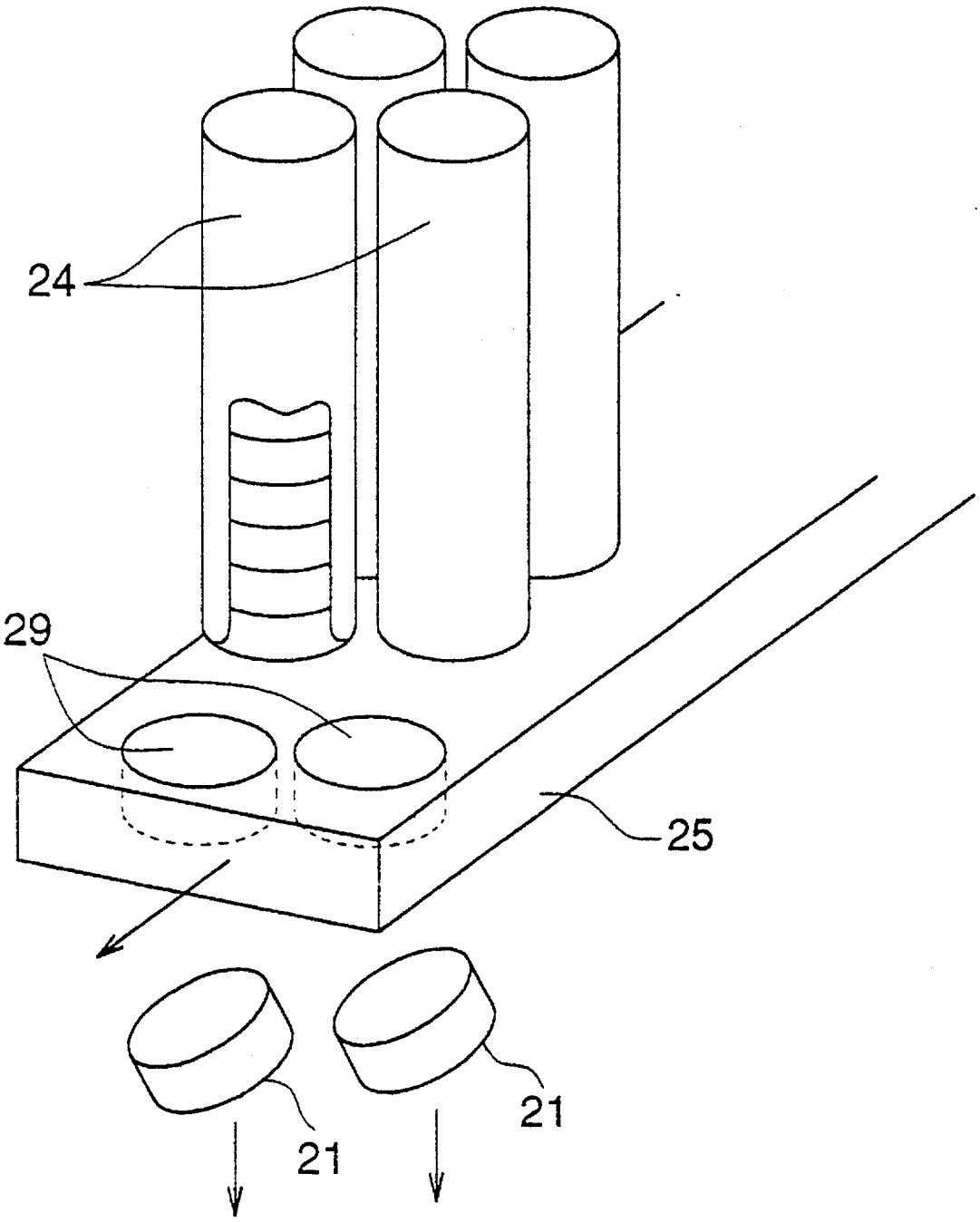
FIG. 5 shows the relation between the tablet-form solid processing composition storing cylinder and the sliding plate in the equipment of FIG. 4.

FIGS. 4 and 5 are schematic overviews of an exemplified automatic supplying apparatus of solid processing composition 8, in which tablets arranged in order are loaded in a package.

Cylindrical tube 24 has its caliber which is a little larger than that of the tablet and contains the tablets 21 as shown in the drawing.

In the container part of the processor, there is arranged a few rows of cylindrical containers 24 containing therein a pile of tablets 21 along the direction of a movable plate member 25.

A top cover 22 is provided up above the container part 23 so that it is removable, which makes the setting of cylinder 24 easy in the container part 23.

On the movable plate member 25, there is at least one movable opening 29 at an appropriate place with sufficient size for the tablet 21 in the cylindrical tube 24 provided in the container part 23 to pass through.

Driving apparatus 26 comprising a moter, etc. for the sliding plate 25 is provided so as to move between the innermost position where cyrinder 21 is set and the position where the opening 30 through which the tablet 21 is supplied to the processing solution.

A filtering bath 27 is provided adjacent to the processing bath, and in the filtering bath a filter 28 is provided so as to be detachable, and it is so designed that the tablet 21 thrown through the opening 30 is not caught by the filter 28.

The filtering bath 27 is so designed that the processing solution may be introduced through the filter 28, whereat unnecessary ingredient generated in the solution, such as sludge, etc., may be removed and the filtered solution may be brought back to the processing bath. Also, the filtering bath 27 plays a role as a dissolving bath for the solid processing composition.

Tablets 21 are contained in the cylinder-shaped tube 24 placing one upon another and placed in the container part 23. Driving apparatus 26 operates correspondingg to processing amounts of the light-sensitive material and the sliding plate 25 moves to and fro, upon which the tablet 21 which fell into the sliding opening 29 moves towards the opening 30, to be thrown into the filtering bath 27 through the opening 30. Then the sliding plate 25 moves back to the initial position and stops there.

Figure 6:
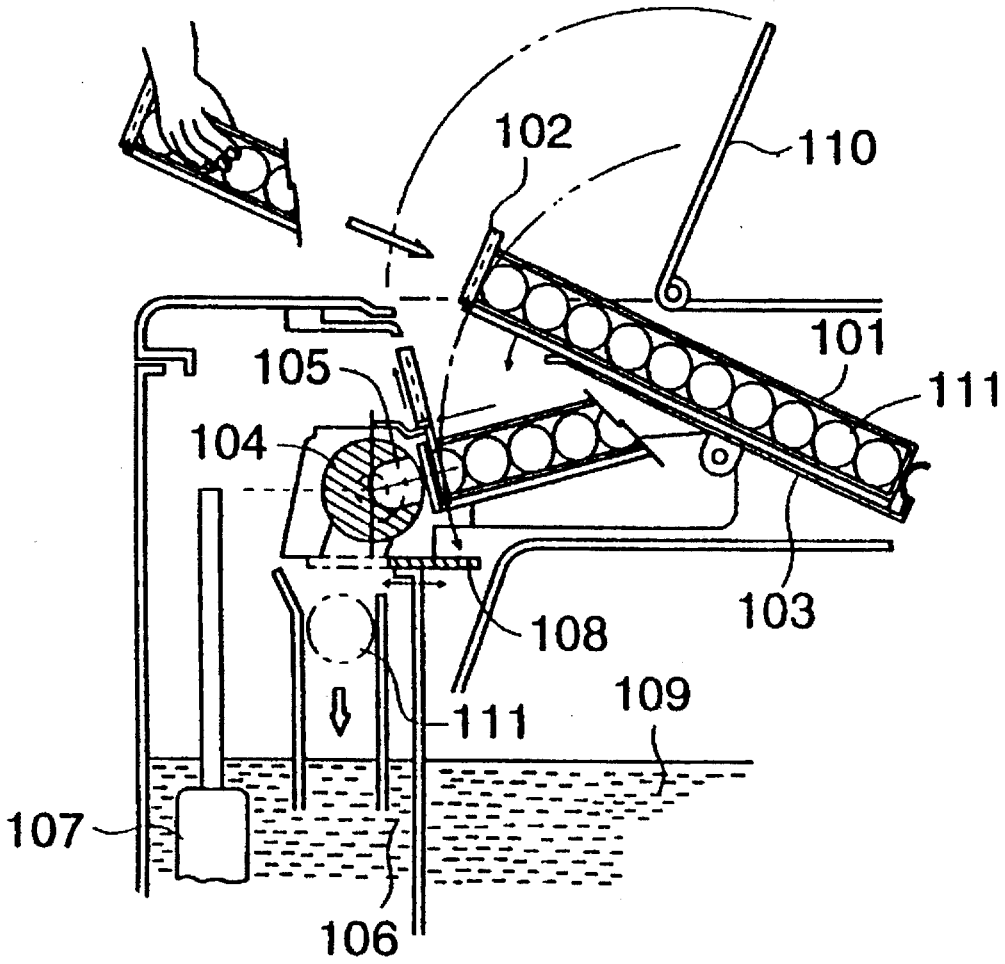
FIG. 6 illustrates another automatic feeder of the tablet-form solid processing composition.

In FIG. 6, another embodiment of automatic supplying apparatus for the solid processing composition is shown 8, in which a row of tablets arranged in order are contained in the package as solid processing composition.

In this embodiment the tablet 111 is contained in a container or a cartridge 101, which is divided into a plurality of rooms and is sealed up at one end thereof with a slidable cap 102. When this cartridge is set on a supporting stand 103 of the cartridge, which is provided above the processing bath of the processor, the cap 102 opens and the tablet tumbles down from the cartridge, which is fixed slantwise into a cut 105 of the rotary cylinder 104. The cut 105 formed in the rotary cylinder 104 is formed alternatively so that a plurality of tablets contained in the different rooms do not fall down simultaneously into the same cut.

Rotary cylinder 104 rotates corresponding to the processed amount of the light-sensitive material and, at the same time, shutter 108 opens, to let the tablet into the filtering bath(or the dissolving bath) 106, which is provided adjacent to the processing bath one by one.

In this embodiment, structure and operation of the filtering bath and the processing baths are the same as in the case of FIGS. 4 and 5.

Figure 7:
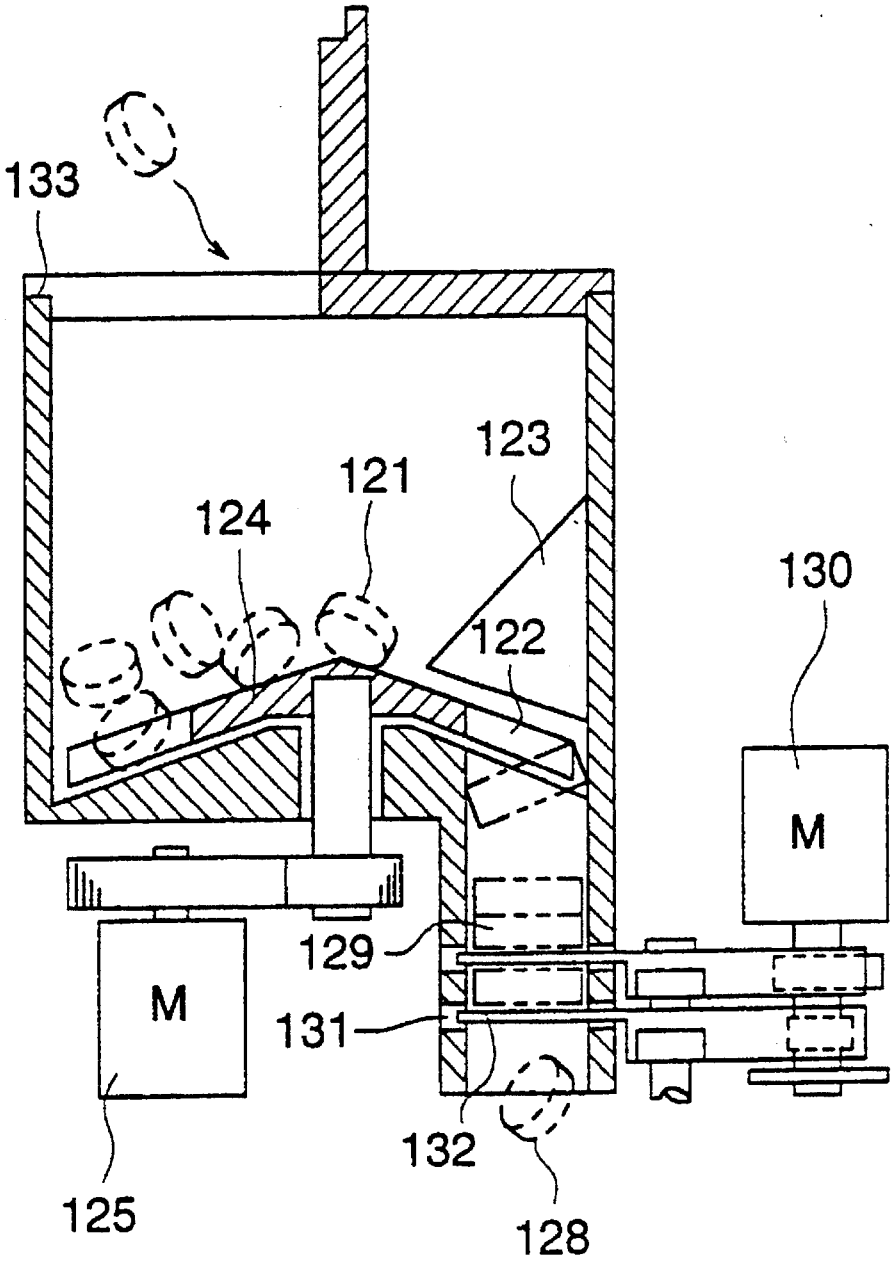
FIG. 7 illustrates another automatic feeder of the tablet-form solid processing composition.

FIG. 7 illustrates an example of a tablet supplying apparatus for the tablets contained in a package, employing parts feeder method.

A wrapping container for the tablets of solid processing composition of the present invention, which may be hereinafter referred to as "the tablets" or "the tablet chemical" was unpacked and the tablets were put into a hopper 133. A movable member 124 rotates correponding to the processing amount of the light-sensitive material and the tablets are drawn up in line in the tablet drawn-up area 129. When predetermined number of the tablets are drawn up the movable member 124 stops.

At this time, sweeper 123 is very effective for the tablets to come into pocket 122 of the movable member 124 and to draw un in the in the draw-up area 129.

Corresponding to the processed amount of the light-sensitive material, driving means for supplying the processing agent which comprises a motor, etc., operates, to rotate the first shutter 131 and to let the tablets fall down. Then the first shutter 131 rotates in the reverse direction and helds just one tablet between the sutters 131 and 132. Thereafter, the shutter 132 rotates, to let the tablet pass through delivery part to supplying portion. Then the shutter 132 rotates reversely and the first shutter 131 closes.

Experiment:

Using three types of automatic supplying apparatuses,for the solid processing composition as shown in FIGS. 4 and 5, FIG. 6 and FIG. 7, an experiment of adding tablets of solid processing composition prepared in (1) and (2) as above was carried out. At this time, temperature and the relative humidity around the supplying apparatus were adjusted at 25° C. and 65%, respectively.

Throwing of the tablets was carried out continuously about 2000 tablets and evaluation was made as to troubles, if any, in the supplying apparatus and as to whether the addition of the tablets was carried out without any difficulty or not.

Results are shown in Table 6.

TABLE 6

| Experiment No. | Tablet Supplying Apparatus | Processing Composition | Cover-coating Material | Trouble on Tablet-supplying | Remarks |
|---|---|---|---|---|---|
| 6-1 | FIG. 4 | Color Developer | None | Crevice between sliding platemembers was choked with powder and smooth movement became impossible. | Comp. |
| 6-2 | FIG. 4 | Color Developer | Polyethyleneglycol 6000 | No problem | Inv. |
| 6-3 | FIG. 4 | Color Developer | Yuka foamer (*6) | No problem | Inv. |
| 6-4 | FIG. 5 | Color Developer | None | Gap around the rotary cylinder was choked with powder and smooth movement became impossible. | Comp. |
| 6-5 | FIG. 5 | Color Developer | Polyethyleneglycol 6000 | No problem | Inv. |
| 6-6 | FIG. 5 | Color Developer | Erythritol | No problem | Inv. |
| 6-7 | FIG. 5 | Color Developer | Maltose | No problem | Inv. |
| 6-8 | FIG. 5 | Color Developer | Yuka foamer (*6) | No problem | Inv. |
| 6-9 | FIG. 6 | Color Developer | None | Crevice in the movable member was choked with powder and smooth movement became impossible. | Comp. |
| 6-10 | FIG. 6 | Color Developer | Polyethyleneglycol 6000 | No problem | Inv. |
| 6-11 | FIG. 6 | Color Developer | Yuka foamer (*6) | No problem | Inv. |
| 6-12 | FIG. 4 | Bleach-Fixer | None | Solid material was adhered to the sliding plate and the apparatus stopped. | Comp. |
| 6-13 | FIG. 4 | Bleach-Fixer | Erythritol | No problem | Inv. |
| 6-14 | FIG. 4 | Bleach-Fixer | Yuka foamer (*6) | No problem | Inv. |

TABLE 6-continued

| Experiment No. | Tablet Supplying Apparatus | Processing Composition | Cover-coating Material | Trouble on Tablet-supplying | Remarks |
|---|---|---|---|---|---|
| 6-15 | FIG. 5 | Bleach-Fixer | None | Tablet was adhered to the wall of the cartridge and therewere some failure of addition of the tablet. | Comp. |
| 6-16 | FIG. 5 | Bleach-Fixer | Erythritol | No problem | Inv. |
| 6-17 | FIG. 5 | Bleach-Fixer | Yuka foamer (*6) | No problem | Inv. |
| 6-18 | FIG. 6 | Bleach-Fixer | None | Solid material was adhered to the movable member and the apparatus ceased to move. | Comp. |
| 6-19 | FIG. 6 | Bleach-Fixer | Erythritol | No problem | Inv. |
| 6-20 | FIG. 6 | Bleach-Fixer | Yuka foamer (*6) | No problem | Inv. |

(*6) A product of Mitubishi Yuka Co. Ltd., mixture of Yuka Foamer Am-75 W and polyethyleneglycol 600 as a plasticizer with the mixing proportion of 20:1.

Example 7

Tablets were prepared in the same manner as in (2) of Example 1, provided that compression pressure upon manufacturing the tablet was varied so as to change tensile strength of the tablet as shown in Table 7.

Thus prepared tablets were coated on its surface with YUKA FOAMER AM-75W containing polyethyleneglycol 600 as a plasticizer in weight proportion of 1.0% with respect to the weight of the tablet.

Frictional abrasion, solubility and hygroscopic property were evaluated in the same manner as in Example 1. Results thereof are shown in Table 7.

TABLE 7

| Experiment No. | Tensile Strength | Frictional Abrasion | Solubility | Hygroscopic Property |
|---|---|---|---|---|
| 7-1 | 2 | G | G | G |
| 7-2 | 4 | G | G | G |
| 7-3 | 5 | E | G | E |
| 7-4 | 10 | E | G | E |
| 7-5 | 30 | E | G | E |
| 7-6 | 50 | E | G | E |
| 7-7 | 60 | E | F | E |

From Table 7, it is understood that the advantages of the present invention become remarkable when the stensile strength of the tablet is 5 to 50 kg/cm$^2$.

Example 8

Tablets of color developing composition for color paper were prepared in the same manner as in (1) and (2) of Example 1. The tablets thus prepared were in cover-coating in the same manner as 8) of Example 3, using coating solutions of which compositions are given below.

| | (Composition ratio) |
|---|---|
| Coating Solution 1: | |
| YUKA FOAMER AM-75W (30% soln.) | 60 |
| Bis(sulfoethyl)hydroxylamine disodium salt | 10 |
| water | 30 |
| Coating Solution 2: | |
| YUKA FOAMER AM-75 510 (18% soln.) | 80 |
| Propylene glycol | 2 |
| water | 18 |

Using these tablets, color changes after storage and adaptability to addition by the use of an automaytic supplying apparatus were evaluated.

(a) Coloring after Storage: Evaluation was made in the same manner as in Example 3.

(b) Adaptability of Addition:

Ten tablets portion of solid processing composition were put in the respective raws of the divided rooms of packaging container as shown in FIG. 2(IV). Then the container was inclined until all the tablets tumbled down off the container. Angle at which all tablets fell off was measured and the average value of ten measurements were taken for the following evaluation.

Criterion For Evaluation:

E: Excellent; Not more than 5°

G: Good; Between 5° and 10°

F: Fair; Between 10° and 15°

P: poor; More than 15°

Results are shown in Table 8.

TABLE 8

| Experiment No. | Coating Solution | Weight Ratio of Coating Material | Coloring | Adaptability to Addition | Remarks |
|---|---|---|---|---|---|
| 8-1 | 1 | 1.0 | A | G | Single layer Coating |
| 8-2 | 2 | 1.0 | B | E | Single layer Coating |
| 8-3 | Undercoat 1 | 0.5 | A | E | Double Layer Coating |
| | Overcoat 2 | 0.5 | | | |

As obvious from Table 8, by coating the tablets with a coating solution containing a material having excellent anti-coloring effect and one containing a material capable of enhancing adaptability, in double-layered structure, tablets with improved properties with all respects were obtained.

What is claimed is:

1. A solid photographic processing composition in tablet form for a silver halide photographic light sensitive material comprising a developing agent, bleaching agent, fixing agent or imaging stabilizing agent, wherein said solid composition has a bulk density of 1.0 to 2.5 g/cm$^3$, and substantially the whole of the surface of said solid processing composition is covered with a layer containing a compound in an amount of 0.5 to 5% by weight based on the total weight of the composition, said compound being a polyalkylene glycol having an average molecular weight of 2000 to 20000, and wherein said solid processing composition in tablet form has a weight of 0.5 to 50 g per a tablet.

2. The solid processing composition of claim 1, wherein said polyalkylene glycol is represented by formula, formula $$HO—(A)n_1—(B)n_2—(C)n_3—H$$

wherein A, B and C independenly represent —$CH_2CH_2O$—, —$CH(R_{12})$—$CH_2O$—, —$CH_2CH_2CH_2O$— or —$CH_2$—$CH(R_{12})$—$CH_2O$—, in which $R_{12}$ represents an alkyl group or hydroxy, and $n_1$, $n_2$ and $n_3$ each zero or an integer of 1 to 500.

3. The solid processing composition of claim 1, wherein said solid processing composition in tablet form has a weight of 2.0 to 20 g per a tablet.

4. The solid processing composition of claim 1, wherein said solid processing composition in tablet form is prepared by compression-molding a solid composition in granular form having an average grain size of 100 to 1000 μm.

5. The solid processing composition of claim 1, wherein said solid processing composition in tablet form is covered with at least two layers different in composition thereof.

6. A package of processing chemicals for a silver halide photographic light sensitive material, wherein plural tablets of a solid photographic processing composition comprising a developing agent, bleaching agent fixing agent or image stabilizing agent, are enclosed in one package, said solid composition has a bulk density of 1.0 to 2.5 g cm$^3$ and substantially the whole of the surface of said tablet is covered with a layer containing a compound, in an amount of 0.05 to 5% by weight based on the total weight of the composition, said compound being a polyalkylene glycol having an average molecular weight of 2000 to 20000, and wherein each tablet has a weight of 0.5 to 50 grams.

7. A method of processing a silver halide light sensitive photographic material with an automatic processor comprising:

a processing tank containing a processing solution, and a section in which the processing solution circulates from the processing tank, wherein a tablet-formed solid processing composition comprising a developing agent, bleaching agent, fixing agent or image stabilizing agent, is introduced, as a replenisher, into the processing tank or the circulation section, said solid processing composition having a bulk density of 1.0 to 2.5 g/cm$^3$ and substantially the whole of the surface of said tablet-form solid composition being covered with a layer containing a compound in an amount of 0.05 to 5% by weight based on the total weight of the composition, said compound being a polyalkylene glycol having an average molecular weight of 2000 to 20000, and wherein the tablet-formed composition has a weight of 0.5 to 50 grams.

* * * * *